US005889425A

United States Patent [19]

Kimura

[11] Patent Number: 5,889,425

[45] Date of Patent: Mar. 30, 1999

[54] ANALOG MULTIPLIER USING QUADRITAIL CIRCUITS

[75] Inventor: Katsuji Kimura, Tokyo, Japan

[73] Assignee: NEC Corporation, Tokyo, Japan

[21] Appl. No.: 604,292

[22] Filed: Feb. 21, 1996

Related U.S. Application Data

[63] Continuation of Ser. No. 179,955, Jan. 11, 1994.

[30] Foreign Application Priority Data

Jan. 11, 1993 [JP] Japan ..... 5-019358

[51] Int. Cl.[6] ..... G06G 7/16

[52] U.S. Cl. ..... 327/359; 327/357; 327/116; 327/119

[58] Field of Search ..... 307/529, 498, 307/494, 201; 328/160; 330/252, 253, 260; 327/356, 357, 359, 563, 350, 351, 355, 116, 119

[56] References Cited

U.S. PATENT DOCUMENTS

| | | | |
|---|---|---|---|
| 4,308,471 | 12/1981 | Misawa | 328/160 |
| 4,344,043 | 8/1982 | Harford | 330/254 |
| 4,379,268 | 4/1983 | Nagata | 330/257 |
| 5,086,241 | 2/1992 | Nakayama | 328/160 |
| 5,107,150 | 4/1992 | Kimura | 328/160 |
| 5,151,624 | 9/1992 | Stegherr et al. | 307/529 |
| 5,187,682 | 2/1993 | Kimura | 364/841 |
| 5,329,189 | 7/1994 | Ushida et al. | 327/105 |
| 5,438,296 | 8/1995 | Kimura | 327/560 |
| 5,523,717 | 6/1996 | Kimura | 330/252 |
| 5,552,734 | 9/1996 | Kimura | 327/356 |
| 5,576,653 | 11/1996 | Kimura | 327/356 |
| 5,578,965 | 11/1996 | Kimura | 330/254 |
| 5,581,210 | 12/1996 | Kimura | 327/355 |

FOREIGN PATENT DOCUMENTS

| | | | |
|---|---|---|---|
| 4-34673 | 2/1992 | Japan . | |
| 4343505 | 11/1992 | Japan | 307/498 |
| 5-94552 | 4/1993 | Japan . | |
| 2256550 | 12/1992 | United Kingdom . | |

OTHER PUBLICATIONS

Zhenhua Wang, "A CMOS Four–Quadrant Analog Multiplier . . . and Improved Temperature Performance", IEEE Journal of Solid–State Circuits, vol. 26, No. 9, Sep. 1991, pp. 1293–1301.

Katsuji Kimura, "An MOS Operational Transconductance . . . Multiplier Using the Quadritail Cell", IEICE Trans. Fundamentals, vol. E75–A, No. 12, Dec. 1992, pp. 1774–1776.

Babanezhad et al., "A 20–V Four Quadrant CMOS Analog Multiplier", IEEE Journal of Solid–State Circuits, vol. SC–20, No. 6, pp. 1158–1167, Dec. 1985.

(List continued on next page.)

*Primary Examiner*—Timothy P. Callahan
*Assistant Examiner*—Terry L. Englund
*Attorney, Agent, or Firm*—Sughrue, Mion, Zinn, Macpeak & Seas, PLLC

[57] ABSTRACT

A multiplier containing first and second quadritail cells. The first quadritail cell has a first pair of first and second transistors, a second pair of third and fourth transistors, and a first constant current source for driving the first and second pairs. The second quadritail cell has a third pair of fifth and sixth transistors, a fourth pair of seventh and eighth transistors, and a second constant current source for driving the third and fourth pairs. A first input voltage is applied between input ends of the first and fourth transistors and is applied between input ends of the fifth and eighth transistors. A second input voltage is applied between input ends coupled together of the second and third transistors and the input ends coupled together of the sixth and seventh transistors. The output ends of the first and fourth pairs are coupled together to form one of differential output ends, and those of the second and third pairs are coupled together to form the other of the differential output ends thereof. At least one of the first and second input voltages can be expanded in linear range at a low power source voltage such as 3 or 3.3 V.

10 Claims, 20 Drawing Sheets

OTHER PUBLICATIONS

Katsuji Kimura, "A Bipolar Very Low–Voltage Multiplier Core Using a Quadritail Cell", May 1995, IEICE Trans. Fundamentals, vol. E78–A, No. 5, pp. 560–565.

Katsuji Kimura, "Synthesis of Bipolar Very Low–Voltage Four–Quadrant Analog Multipliers Based on the Multitail Technique", Fundamental Technologies Development Dept., pp. 1–40.

Katsuji Kimura, "A Bipolar Four–Quadrant Analog Quarter–Square Multiplier Consisting of Unbalanced Emitter–Coupled Pairs and Expansions of Its Input Ranges", Jan. 1994, IEEE Journal of Solid–State Circuits, vol. 29, No. 1, pp. 46–55.

Katsuji Kimura, "Circuit Design Techniques for Very Low–Voltage Analog Functional Blocks Using Triple–Tail Cells", Nov. 1995, IEEE Transactions on Circuits and Systems—I: Fundamental Theory and Applications, vol. 42, No. 11, pp. 873–885.

Katsuji Kimura, "Some Circuit Design Techniques for Low–Voltage Analog Functional Elements Using Squaring Circuits", Sep. 1995, IEEE Transactions on Circuits and Systems—I: Fundamental Theory and Applications, vol. 42, No. 9, pp. 1–18.

K. Kimura, "An MOS Operational Transconductance Amplifier and an MOS Four–Quadrant Analog . . . Quadritail Cell", IEICE Trans. Fundamentals, vol. E75–A, No. 12, Dec. 1992, pp. 1774–1776.

K. Kimura, "A Unified Analysis of Four–Quadrant Analog Multipliers Consisting of Emitter . . . Low Supply Voltage", IEICE Translations on Electronics, vol. E76–C, No. 5, May 1993, pp. 714–737.

Z. Wang, "A CMOS Four–Quadrant Analog Multiplier with Single–Ended Voltage Output and Improved . . . Performance", IEEE Journal of Solid–State Circuits, vol. 26, No. 9, Sep. 1991, pp. 1293–1301.

Tsukahara et al., "Low–Voltage Techniques for High–Frequency Si–Bipolar Circuits", MWE '93 Microwave Workshop Digest, pp. 357–360.

ANALOG MULTIPLIER USING QUADRITAIL CIRCUITS

This is a Continuation of application Ser. No. 08/179,995 filed Jan. 11, 1994.

BACKGROUND OF THE INVENTION

1. Field of the Invention

The present invention relates a multiplier and more particularly, to a multiplier for two analog signals using quadritail circuits formed of bipolar transistors or Metal-Oxide-Semiconductor (MOS) transistors, which is realized on semiconductor integrated circuits.

2. Description of the Prior Art

An analog multiplier constitutes a functional circuit block essential for analog signal applications. Recently, semiconductor integrated circuits have been made finer and finer and as a result, their power source voltages have been decreasing from 5 V to 3.3 or 3 V. Under such a circumstance, low-voltage circuits which can be operated at such a low voltage as 3 V has been required to be developed. In the case, the linear ranges of the input voltages of the multipliers need to be wide as much as possible.

A Gilbert multiplier cell is well known as a bipolar multiplier. However, the Gilbert multiplier cell has such a structure that bipolar transistor-pairs are provided in a two-stage stacked manner and as a result, it cannot respond to reduction of the operating power source voltage.

Besides, the Complementary MOS (CMOS) technology has become recognized to be the optimum process technology for Large Scale Integration (LSI), so that multipliers which can be realized using the CMOS technology have been required.

The inventor developed multipliers as shown in FIGS. 1, 4 and 7 and filed Japanese patent applications about them. With these multipliers, two squaring circuits are arranged in a line transversely, not in a stack manner, to be driven by the same power source voltage. The circuit configuration was developed such that the product of first and second input voltages is given by subtracting the square of the difference of the first and second input voltages from the square of the sum thereof.

The above multipliers developed by the inventor were named "quarter-square multipliers" since the constant "4" of involution contained in the term of the product was changed to "1".

First, the multiplier shown in FIG. 1 is disclosed in the Japanese Non-Examined Patent Publication No. 5-94552 (Japanese Patent Application No. 4-72629). In FIG. 1, the multiplier includes a first squaring circuit made of bipolar transistors Q1', Q2', Q3' and Q4' and a second squaring circuit made of bipolar transistors Q5', Q6', Q7' and Q8'.

In the first squaring circuit, the transistors Q1' and Q2' form a first unbalanced differential pair driven by a first constant current source (current: $I_0$) and the transistors Q3' and Q4' form a second unbalanced differential pair driven by a second constant current source (current: $I_0$). The transistor Q1' is K times in emitter size or area as much as the transistor Q2' and the transistor Q4' is K times in emitter size as much as the transistor Q3'.

Emitters of the transistors Q1' and Q2' are connected in common to the first constant current source, and emitters of the transistors Q3' and Q4' are connected in common to the second constant current source.

In the second squaring circuit, the transistors Q5' and Q6' form a third unbalanced differential pair driven by a third constant current source (current: $I_0$) and the transistors Q7' and Q8' form a fourth unbalanced differential pair driven by a fourth constant current source (current: $I_0$). The transistor Q5' is K times in emitter size as much as the transistor Q6' and the transistor Q8' is K times in emitter size as much as the transistor Q7'.

Emitters of the transistors Q5' and Q6' are connected in common to the third constant current source, and emitters of the transistors Q7' and Q8' are connected in common to the fourth constant current source.

Bases of the transistors Q1' and Q3' are coupled together to be applied with a first input voltage $V_x$, and bases of the transistors Q2' and Q4' are coupled together to be applied with a second input voltage $V_y$.

Bases of the transistors Q5' and Q7' are coupled together to be applied with the first input voltage $V_x$, and bases of the transistors Q6' and Q8' are coupled together to be applied in opposite phase with the second input voltage $V_y$, or $-V_y$.

The transfer characteristics and the transconductance characteristics of the multiplier are shown in FIGS. 2 and 3, respectively, where K is $e^2$ ($\approx$7.389). A differential output current $\Delta I$ shown in FIG. 2 is defined as the difference of output currents $I_p$ and $I_q$ shown in FIG. 1, or $(I_p-I_q)$.

FIG. 2 shows the relationship between the differential output current $\Delta I$ and the first input voltage $V_x$ with the second input voltage $V_y$ as a parameter. FIG. 3 shows the relationship between the transconductance $(d\Delta I/dV_x)$ and the first input voltage $V_x$ with the second input voltage $V_y$ as a parameter.

Second, the prior-art multiplier developed by the inventor shown in FIG. 4 is disclosed in the Japanese Non-Examined Patent Publication No. 4-34673 (1992). In FIG. 4, the multiplier includes a first squaring circuit made of MOS transistors M1', M2', M3' and M4' and a second squaring circuit made of MOS transistors M5', M6', M7' and M8'.

In the first squaring circuit, the transistors M1' and M2' form a first unbalanced differential pair driven by a first constant current source (current: $I_0$), and the transistors M3' and M4' form a second unbalanced differential pair driven by a second constant current source (current: $I_0$). The transistor M2' is K times in ratio (W/L) of a gate-width W to a gate-length L as much as the transistor M1', and the transistor M3' is K times in ratio (W/L) of a gate-width W to a gate-length L as much as the transistor M4'.

Sources of the transistors M1' and M2' are connected in common to the first constant current source, and sources of the transistors M3' and M4' are connected in common to the second constant current source.

In the second squaring circuit, the transistors M5' and M6' form a third unbalanced differential pair driven by a third constant current source (current: $I_0$), and the transistors M7' and M8' form a fourth unbalanced differential pair driven by a fourth constant current source (current: $I_0$). The transistor M6' is K times in ratio (W/L) of a gate-width W to a gate-length L as much as the transistor M5', and the transistor M7' is K times in ratio (W/L) of a gate-width W to a gate-length L as much as the transistor M8'.

Sources of the transistors M5' and M6' are connected in common to the third constant current source, and sources of the transistors M7' and M8' are connected in common to the fourth constant current source.

Gates of the transistors M1' and M3' are coupled together to be applied with a first input voltage $V_x$, and gates of the transistors M2' and M4' are coupled together to be applied in opposite phase with a second input voltage $V_y$, or $-V_y$.

Gates of the transistors M5' and M7' are coupled together to be applied with the first input voltage $V_x$, and gates of the transistors M6' and M8' are coupled together to be applied with the second input voltage $V_y$.

In FIG. 4, the transconductance parameters of the transistors M1', M4', M5' and M8' are equal to be β, and those of the transistors M2', M3', M6' and M7' are equal to be Kβ.

The transfer characteristics and the transconductance characteristics of the multiplier are shown in FIGS. 5 and 6, respectively, where K is 5. A differential output current ΔI shown in FIG. 5 is defined as the difference of output currents $I^+$ and $I^-$ shown in FIG. 4, or $(I^+-I^-)$.

FIG. 5 shows the relationship between the differential output current ΔI and the first input voltage $V_x$ with the second input voltage $V_y$ as a parameter. FIG. 6 shows the relationship between the transconductance $(d\Delta I/dV_x)$ and the first input voltage $V_x$ with the second input voltage $V_y$as a parameter.

Third, the prior-art multiplier developed by the inventor shown in FIG. 7 is disclosed in IEICE TRANSACTIONS ON FUNDAMENTALS, Vol. E75-A, No. 12, December, 1992. In FIG. 7, the multiplier includes a first squaring circuit made of MOS transistors M1", M2", M3" and M4" and a first constant current source (current: $I_0$) for driving the transistors M1", M2", M3" and M4", and a second squaring circuit made of MOS transistors M5", M6", M7" and M8" and a second constant current source (current: $I_0$) for driving the transistors M5", M6", M7" and M8". The transistors M1", M2", M3", M4", M5", M6", M7" and M8" are equal in capacity or ratio (W/L) of a gate-width W to a gate-length L to each other.

The first and second squaring circuits are named as "quadritail circuits" or "quadritail cells", respectively.

In the first quadritail circuit, sources of the transistors M1", M2", M3" and M4" are connected in common to the first constant current source. Drains of the transistors M1" and M2" are coupled together and drains of the transistors M3" and M4" are coupled together. A gate of the transistor M1" is applied with a first input voltage $V_x$, and a gate of the transistor M2" is applied in opposite phase with a second input voltage $V_y$, or $-V_y$. Gates of the transistor M3" and M4" are coupled together to be applied with a middle point voltage of the voltage applied between the gates of the transistors M1" and M2", or $(1/2)(V_x+V_y)$, which is obtained through resistors (resistance: R).

Similarly, in the second quadritail circuit, sources of the transistors M5", M6", M7" and M8" are connected in common to the second constant current source. Drains of the transistors M5" and M6" are coupled together and drains of the transistors M7" and M8" are coupled together. A gate of the transistor M5" is applied with the first input voltage $V_x$, and a gate of the transistor M6" is applied with the second input voltage $V_y$. Gates of the transistor M7" and M8" are coupled together to be applied with a middle point voltage of the voltage applied between the gates of the transistors M5" and M6", or $(1/2)(V_x-V_y)$, which is obtained through resistors (resistance: R).

Between the first and second quadritail circuits, the drains coupled together of the transistors M1" and M2" and the drains coupled together of the transistors M7" and M8" are further coupled together to form one of differential output ends of the multiplier. The drains coupled together of the transistors M3" and M4" and the drains coupled together of the transistors M5" and M6" are further coupled together to form the other of the differential output ends thereof.

The transfer characteristics and the transconductance characteristics of the multiplier are shown in FIGS. 8 and 9, respectively. A differential output current ΔI shown in FIG. 8 is defined as the difference of output currents $I_P$ and $I_Q$ shown in FIG. 7, or $(I_P-I_Q)$.

FIG. 8 shows the relationship between the differential output current ΔI and the first input voltage $V_x$ with the second input voltage $V_y$ as a parameter. FIG. 9 shows the relationship between the transconductance $(d\Delta I/dV_x)$ and the first input voltage $V_x$ with the second input voltage $V_y$ as a parameter.

Fourth, the prior-art multiplier shown in FIG. 10 was developed by Wang, which is disclosed in IEEE Journal of Solid-State Circuits, Vol. 26, No. 9, September, 1991. The circuit in FIG. 10 is modified by the inventor to clarify its characteristics.

In FIG. 10, the multiplier includes one quadritail circuit made of MOS transistors M1'", M2'", M3'" and M4'" and a constant current source (current: $I_0$) for driving the transistors M1'", M2'", M3'" and M4'". The transistors M1'", M2'", M3'" and M4'" are equal in capacity (W/L) to each other.

Sources of the transistors M1'", M2'", M3'" and M4'" are connected in common to the constant current source. Drains of the transistors M1'" and M4'" are coupled together to form one of differential output ends on the multiplier, and drains of the transistors M2'" and M3'" are coupled together to form the other of the differential output ends thereof.

A gate of the transistor M1'" is applied with a first input voltage $(1/2)V_x$ based on a reference point, and a gate of the transistor M2'" is applied in opposite phase with the first input voltage $(1/2)V_x$ or $-(1/2)V_x$ based on the reference point. A gate of the transistor M3'" is applied with a voltage of the half difference of the first input voltage and a second input voltage, or $(1/2)(V_x-V_y)$. A gate of the transistor M4'" is applied with the voltage $(1/2)(V_x-V_y)$ in opposite phase, or $(-1/2)(V_x-V_y)$.

The transfer characteristics and the transconductance characteristics of the multiplier, which were obtained through analysis by the inventor, are shown in FIGS. 11 and 12, respectively. A differential output current ΔI shown in FIG. 11 is defined as the difference of output currents $I_L$ and $I_R$ shown in FIG. 10, or $(I_L-I_R)$.

FIG. 11 shows the relationship between the differential output current ΔI and the first input voltage $V_x$ with the second input voltage $V_y$ as a parameter. FIG. 12 shows the relationship between the transconductance $(d\Delta I/dV_x)$ and the first input voltage $V_x$ with the second input voltage $V_y$ as a parameter.

The multiplier formed of bipolar transistors shown in FIG. 1 has input voltage ranges of superior linearity which is substantially equal to those of the Gilbert multiplier cell. The prior-art multipliers shown in FIGS. 4, 7 and 10, each of which is MOS transistors, have input voltage ranges of superior linearity comparatively wider than those of the Gilbert multiplier cell, respectively. However, when operating at a low power source voltage such as 3 or 3.3 V, input voltage ranges of superior linearity cannot be expanded in all of the prior-art multipliers.

SUMMARY OF THE INVENTION

Accordingly, an object of the present invention is to provide an analog multiplier in which at least one of two input voltages to be multiplied can be expanded in superiorly linear range compared with those of the prior-art multipliers even if operating at a low power source voltage such as 3 or 3.3 V.

A multiplier according to the present invention has first and second quadritail circuits.

The first quadritail cell contains a first pair of first and second transistors whose capacities are the same and whose output ends are coupled together, a second pair of third and fourth transistors whose capacities are the same and whose output ends are coupled together, and a first constant current source for driving the first and second differential pairs.

The second quadritail cell contains a third pair of fifth and sixth transistors whose capacities are the same and whose output ends are coupled together, a fourth pair of seventh and eighth transistors whose capacities are the same and whose output ends are coupled together, and a second constant current source for driving the third and fourth differential pairs.

In the first quadritail cell, a first input voltage is applied between input ends of the first and fourth transistors, and input ends of the second and third transistors are coupled together.

In the second quadritail cell, the first input voltage is applied between input ends of the fifth and eighth transistors, and input ends of the sixth and seventh transistors are coupled together.

A second input voltage is applied between the input ends coupled of the second and third transistors and the input ends coupled of the sixth and seventh transistors.

The output ends coupled together of the first differential pair and those coupled together of the fourth differential pair are coupled together to form one of output ends of the multiplier. The output ends coupled together of the second differential pair and those coupled together of the third differential pair are coupled together to form the other of the output ends thereof.

The first to eighth transistors may be bipolar transistors or MOS transistors.

Here, the "capacity" of the transistor means an emitter size of emitter area in bipolar transistors, and it means a ratio (W/L) of a gate-width and a gate-length in MOS transistors.

With the multiplier according to the present invention, there are provided with the first and second quadritail circuits, and the first to fourth differential pairs forming the both quadritail circuits are arranged so-called in a line transversely, not in a stack manner, to be driven by the same power source voltage. As a result, the multiplier of the present invention can be operated at a low power source voltage such as 3 or 3.3 V.

Also, the first transistor of the first pair and the fourth transistor of the second pair compose a first differential pair, and the second transistor of the first pair and the third transistor of the second pair also compose a second differential pair. Similarly, the fifth transistor of the third pair and the eighth transistor of the fourth pair compose a third differential pair, and the sixth transistor of the third pair and the seventh transistor of the fourth pair compose a fourth differential pair. Further, the output ends coupled together of the first quadritail cell and those coupled together of the second quadritail cell are respectively coupled together in opposite phase, that is, they are cross-coupled.

As a result, at least one of the first and second input voltages can be expanded in superiorly linear range at a low power source voltage such as 3 or 3.3 V.

In a preferred embodiment, the first to eighth transistors are bipolar transistors, each of which has a resistor connected to the corresponding emitter.

In another preferred embodiment, the first to eighth transistors are bipolar transistors, each of which has at least one diode connected to the corresponding emitter.

In these preferred embodiments, there is an additional advantage that at least one of the input voltages can be further expanded in superiorly linear range.

DETAILED DESCRIPTION OF THE PREFERRED EMBODIMENTS

Preferred embodiments of the present invention will be described below referring to FIGS. 13 to 24.

[First Embodiment]

FIGS. 13 to 17 show a multiplier according to a first embodiment of the present invention, which is composed of bipolar transistors.

Figure 13:
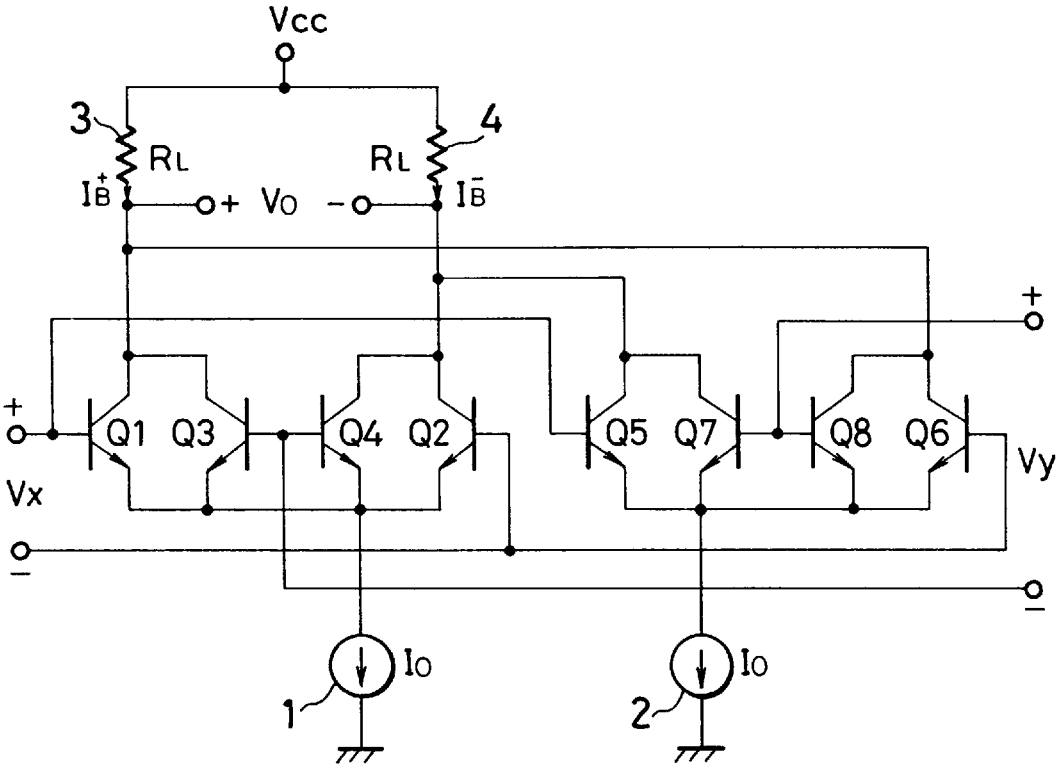
FIG. 13 is a circuit diagram of a multiplier according to a first embodiment of the present invention.

In FIG. 13, four bipolar transistors Q1, Q2, Q3 and Q4 and a first constant current source 1 (current: $I_0$) for driving the transistors Q1, Q2, Q3 and Q4 constitute a first quadritail cell. Four bipolar transistors Q5, Q6, Q7 and Q8 and a second constant current source 2 (current: $I_0$) for driving the transistors Q5, Q6, Q7 and Q8 constitute a second quadritail cell. These eight transistors Q1, Q2, Q3, Q4, Q5, Q6, Q7 and Q8 have the same emitter area.

In the first quadritail cell, the transistors Q1 and Q3 compose a first pair whose output ends or collectors are coupled together, and the transistors Q2 and Q4 compose a second pair whose output ends or collectors are coupled together. Emitters of the transistors Q1, Q2, Q3 and Q4 are connected in common to the first constant current source 1. Bases of the transistors Q3 and Q4 are coupled together.

A first input voltage $V_x$ to be multiplied is applied across bases of the transistors Q1 and Q2. A second input voltage $V_y$ to be multiplied is applied to the bases coupled together of the transistors Q3 and Q4 in negative phase.

In the second quadritail cell, the transistors Q5 and Q7 compose a third pair whose output ends or collectors are coupled together, and the transistors Q6 and Q8 compose a fourth pair whose output ends or collectors are coupled together. Emitters of the transistors Q5, Q6, Q7 and Q8 are connected in common to the second constant current source 2. Bases of the transistors Q7 and Q8 are coupled together.

The first input voltage $V_x$ is applied across bases of the transistors Q5 and Q6. The second input voltage $V_y$ is applied to the bases coupled together of the transistors Q7 and Q8 in positive phase.

Between the first and second quadritail circuits, the collectors coupled together of the transistors Q1 and Q3 and the collectors coupled together of the transistors Q6 and Q8 are further coupled together to form one of differential output ends of the multiplier. The collectors coupled together of the transistors Q2 and Q4 and the collectors of the transistors Q5 and Q7 are further coupled together to form the other of the differential output ends thereof.

In other words, the output end of the first pair of the transistors Q1 and Q3 and that of the fourth pair of the transistors Q6 and Q8, which are in opposite phase to each other, are coupled together. Similarly, the output end of the second pair of the transistors Q2 and Q4 and that of the third pair of the transistors Q5 and Q7, which are in opposite phase to each other, are coupled together. This means that the output ends of the first and fourth pairs are cross-coupled, and those of the second and third pairs are also cross-coupled.

Load resistors (resistance: $R_L$) 3 and 4 are connected to the differential output ends of the multiplier, respectively. A power source voltage $V_{CC}$ is applied through the load resistor 3 to the first and fourth pairs, and it is applied through the load resistor 4 to the second and third pairs.

The second input voltage $V_y$ is applied across the bases coupled together of the transistors Q7 and Q8 and the bases coupled together of the transistors Q3 and Q4.

With the multiplier having the above-described configuration, we suppose that the transistors Q1, Q2, Q3, Q4, Q5, Q6, Q7 and Q8 are matched in characteristic and the base-width modulation can be ignored. Then, collector currents $I_{C1}$, $I_{C2}$, $I_{C3}$ and $I_{C4}$ of the respective transistors Q1, Q2, Q3 and Q4 can be expressed as the following equations 1, 2 and 3, respectively.

$$I_{C1} = I_S \exp\left(\frac{V_R - V_A + \frac{1}{2}V_x}{V_T}\right) \tag{1}$$

$$I_{C2} = I_S \exp\left(\frac{V_R - V_A - \frac{1}{2}V_x}{V_T}\right) \tag{2}$$

$$I_{C3} = I_{C4} = I_S \exp\left(\frac{V_R - V_A + \frac{1}{2}V_y}{V_T}\right) \tag{3}$$

In the equations 1, 2 and 3, $V_T$ is the thermal voltage of the transistors Q1 to Q4 defined as $V_T$=kT/q where k is the Boltzmann's constant, T is absolute temperature in degrees Kelvin and q is the charge of an electron. Also, $I_S$ is the saturation current, $V_R$ is a direct current (dc) component of the first input voltage, and $V_A$ is a common emitter voltage of the transistor Q1, Q2, Q3 and Q4 of the first quadritail cell.

A tail current of the first quadritail cell satisfies the following equation.

$$I_{C1}+I_{C2}+I_{C3}+I_{C4}=\alpha_F I_0 \tag{4}$$

where $\alpha_F$ is the dc common-base current gain factor of the transistors.

The common term $I_S \cdot \exp\{(V_R-V_A)/V_T\}$ contained in the equations 1, 2 and 3 is given as the following equation 5 by solving the equations 1 to 4.

$$I_S \exp\left(\frac{V_R - V_A}{V_T}\right) = \frac{\alpha_F I_0}{2\left\{\cosh\left(\frac{V_x}{2V_T}\right) + \exp\left(-\frac{V_y}{2V_T}\right)\right\}} \tag{5}$$

Similarly, the same equations are obtained about the second quadritail cell of the transistors Q5 to Q8, so that a differential output current $\Delta I_B$ is given as the following equation 6, where $I_{C5}$, $I_{C6}$, $I_{C7}$ and $I_{C8}$ are collector currents of the respective transistors Q5, Q6, Q7 and Q8.

$$\begin{aligned}\Delta I_B &= I_B^+ - I_B^- \\ &= (I_{C1} + I_{C3} + I_{C6} + I_{C8}) - (I_{C2} + I_{C4} + I_{C5} + I_{C7}) \\ &= \frac{2\alpha_F I_0 \sinh\left(\frac{V_x}{2V_T}\right)\sinh\left(\frac{V_y}{2V_T}\right)}{\left\{\cosh\left(\frac{V_x}{2V_T}\right)+\exp\left(\frac{V_y}{2V_T}\right)\right\}\left\{\cosh\left(\frac{V_x}{2V_T}\right)+\exp\left(-\frac{V_y}{2V_T}\right)\right\}}\end{aligned} \tag{6}$$

From the equation 6, it is seen that the multiplier has a limiting characteristic concerning the second input voltage $V_y$ while it does not have a limiting characteristic concerning the first input voltage $V_x$.

Figure 14:
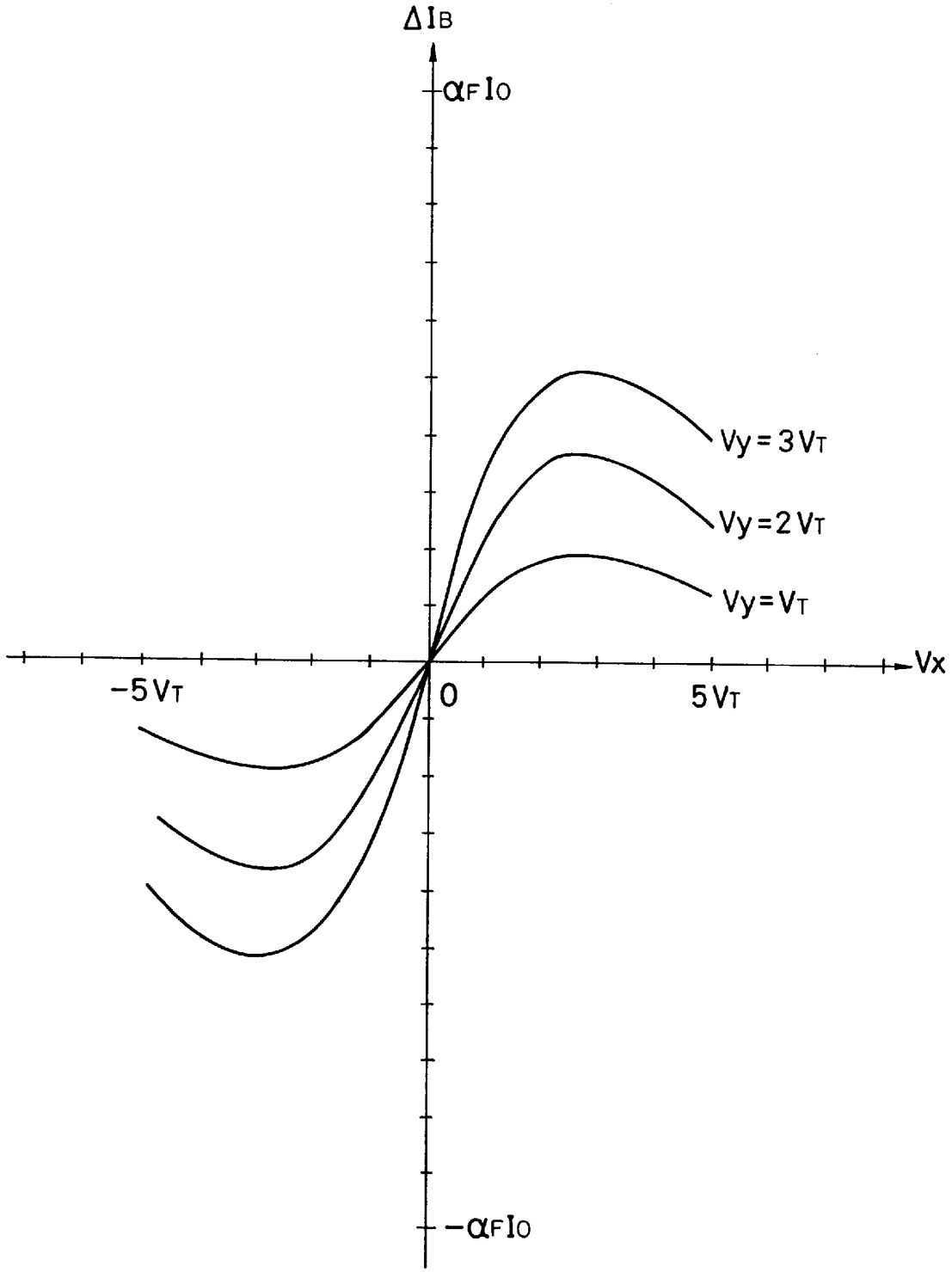
FIG. 14 shows the transfer characteristics of the multiplier of the first embodiment shown in FIG. 13, in which the relationship between the differential output current $\Delta I_B$ and the first input voltage $V_x$ is shown with the second input voltage $V_y$ as a parameter.
Figure 15:
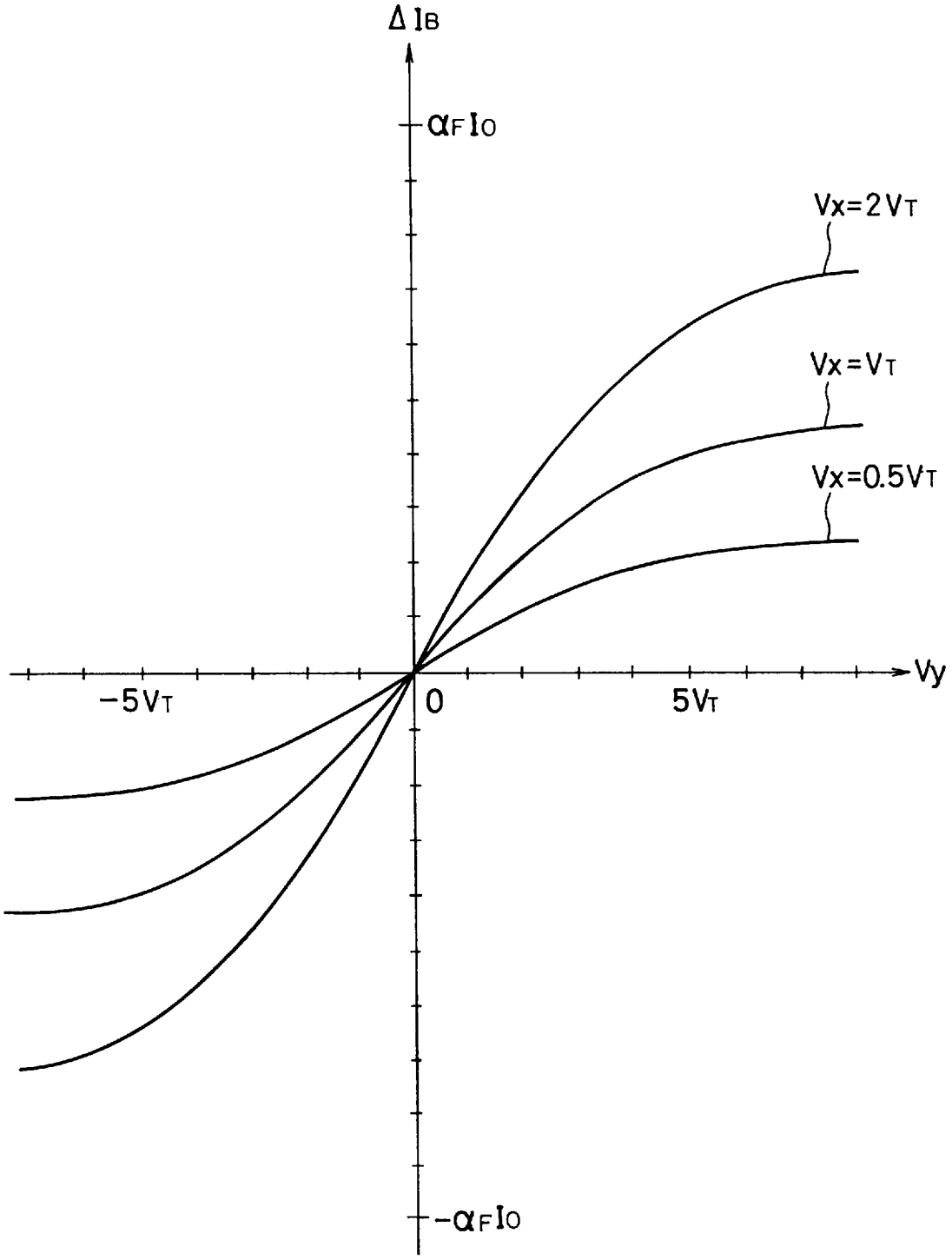
FIG. 15 shows the transfer characteristics of the multiplier of the first embodiment shown in FIG. 13, in which the relationship between the differential output current $\Delta I_B$ and the second input voltage $V_y$ is shown with the first input voltage $V_x$ as a parameter.

The transfer characteristics of the multiplier of the first embodiment concerning the first and second input voltage $V_x$ and $V_y$ are shown in FIGS. 14 and 15, respectively. FIG. 14 shows the relationship between the differential output current $\Delta I_B$ and the first input voltage $V_x$ with the second input voltage $V_y$ as a parameter. FIG. 15 shows the relationship between the differential output current $\Delta I_B$ and the second input voltage $V_y$ with the first input voltage $V_x$ as a parameter.

Figure 1:
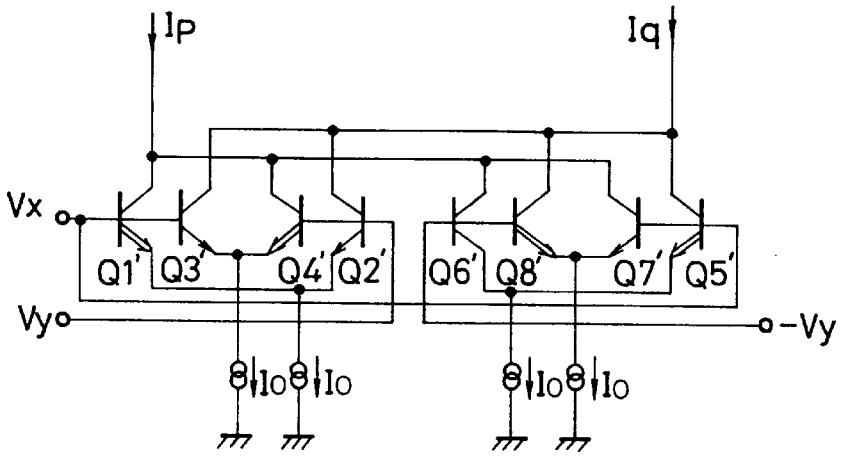
FIG. 1 PRIOR ART
FIG. 1 is a circuit diagram showing a first example of the multipliers.
Figure 4:
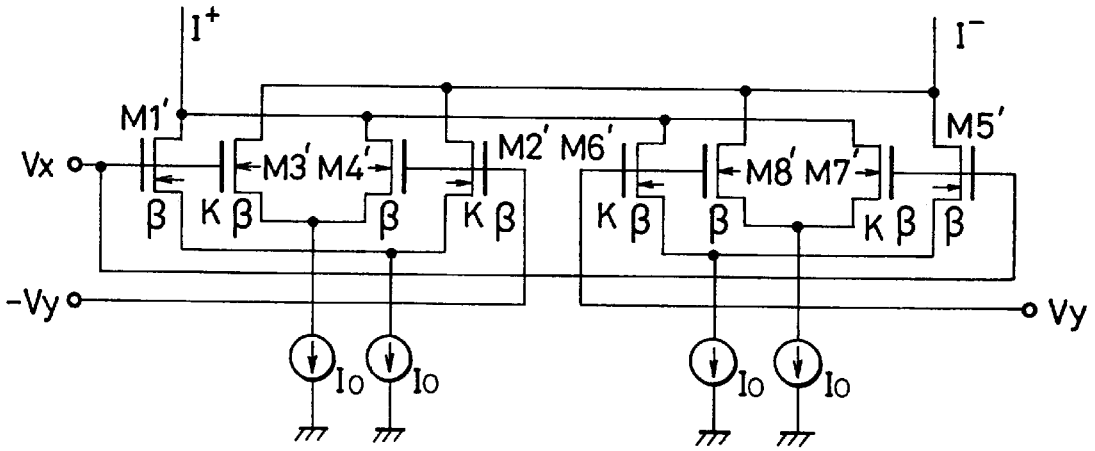
FIG. 4 PRIOR ART
FIG. 4 is a circuit diagram showing an example of a prior-art multiplier.
Figure 2:
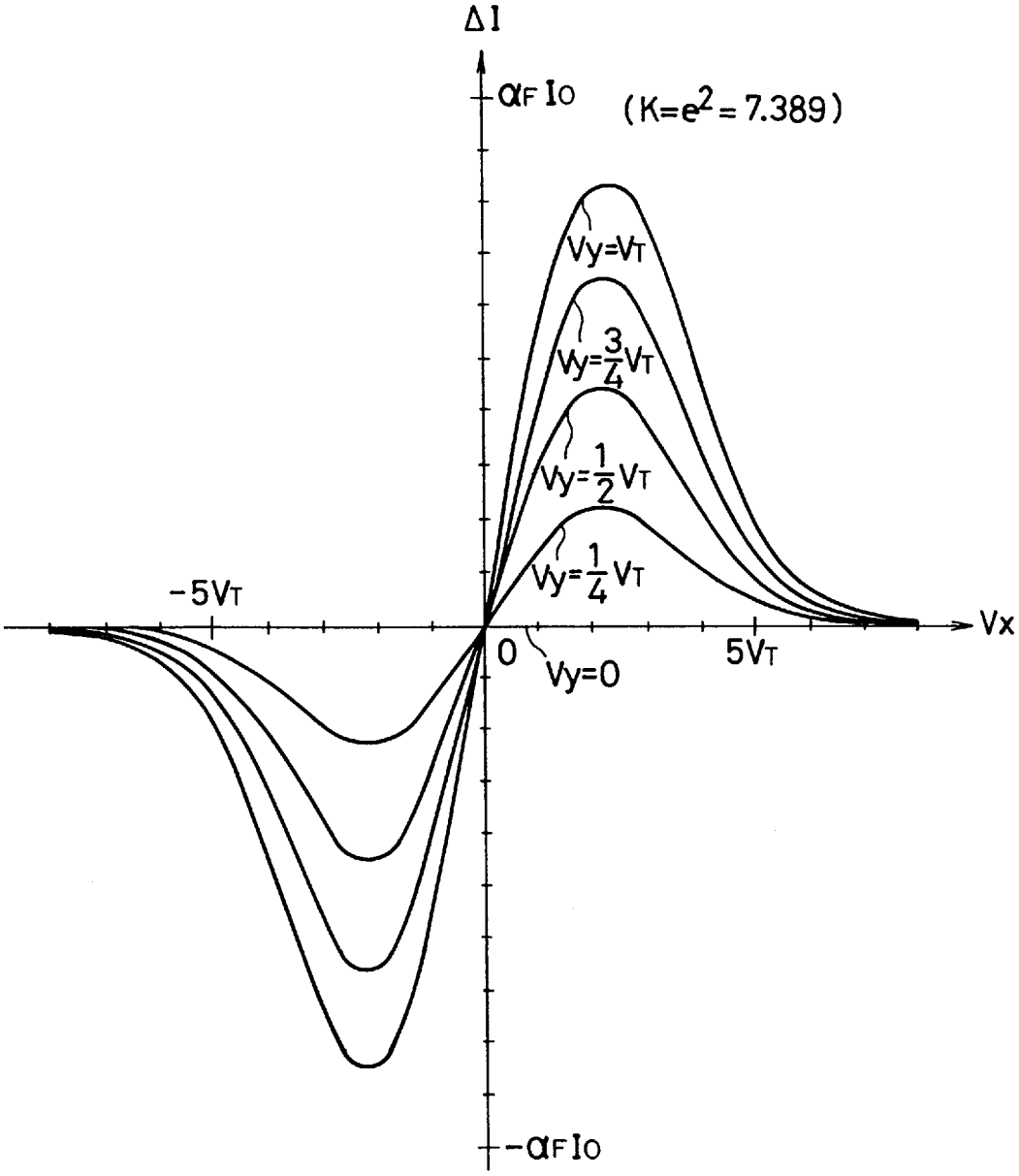
FIG. 2 shows the transfer characteristics of the multiplier shown in FIG. 1.
Figure 3:
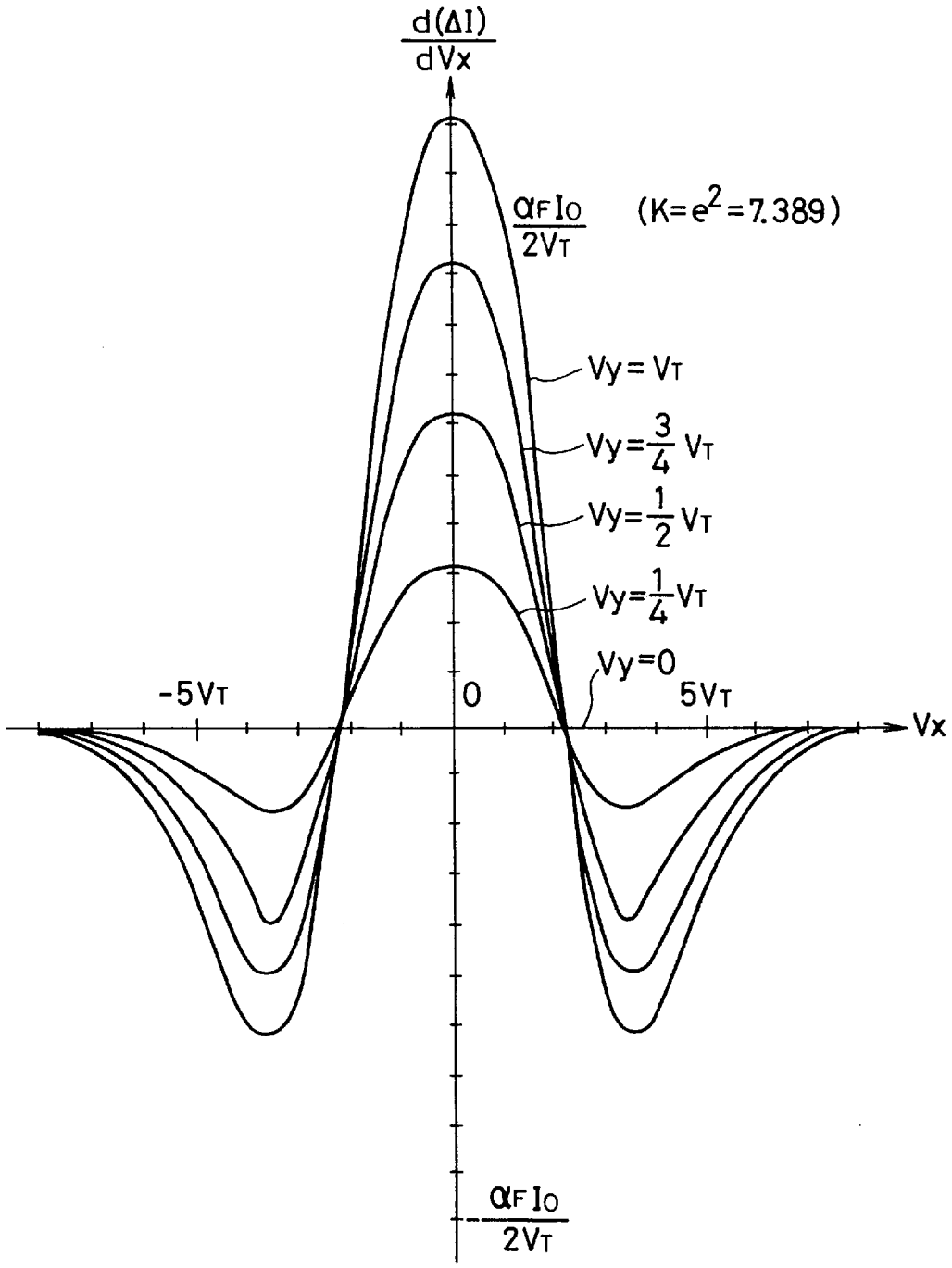
FIG. 3 shows the output characteristics of the multiplier shown in FIG. 1.
Figure 5:
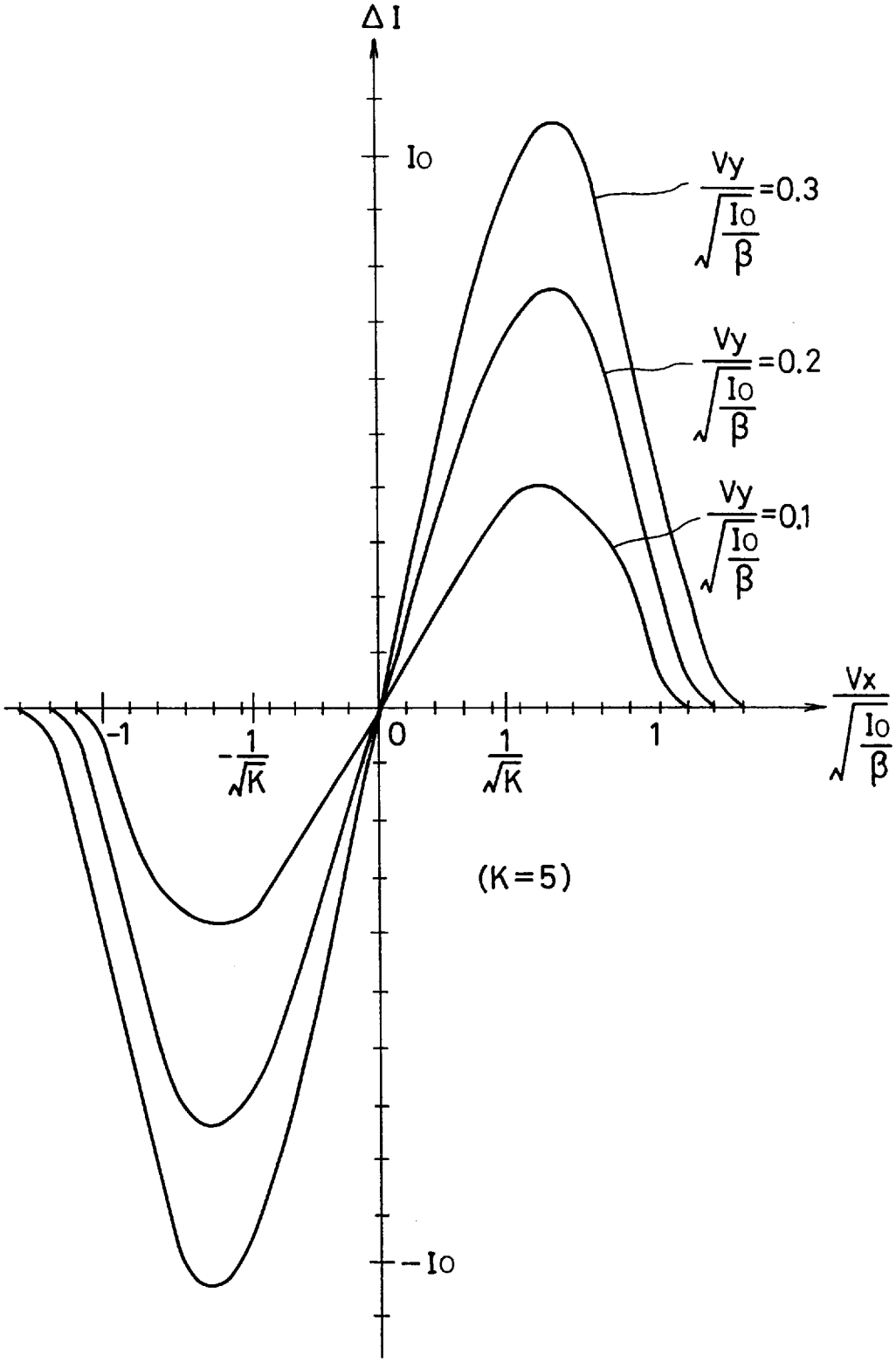
FIG. 5 PRIOR ART
FIG. 5 shows the transfer characteristics of the prior-art multiplier shown in FIG. 4.
Figure 6:
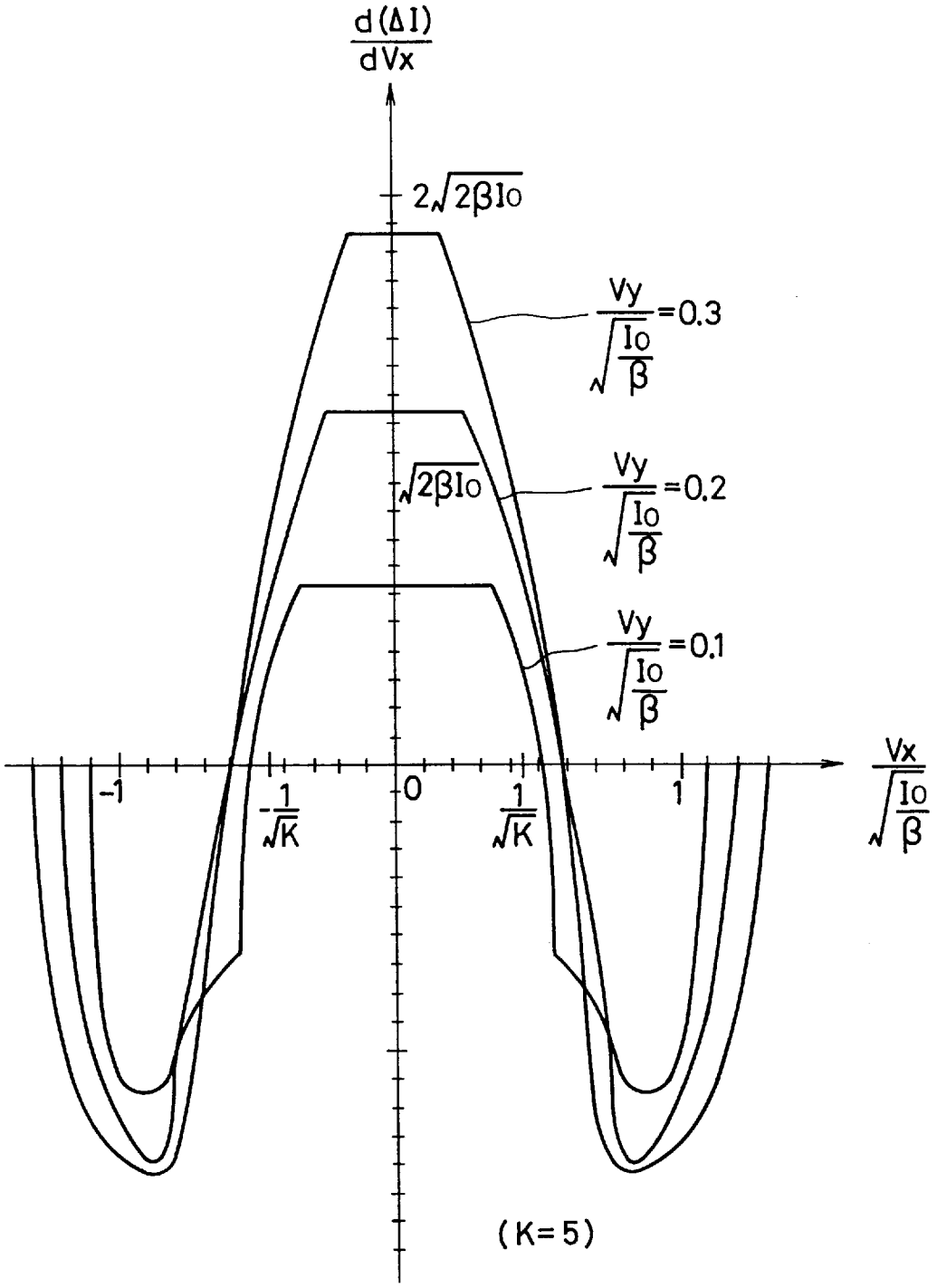
FIG. 6 PRIOR ART
FIG. 6 shows the output characteristics of the prior-art multiplier shown in FIG. 4.
Figure 7:
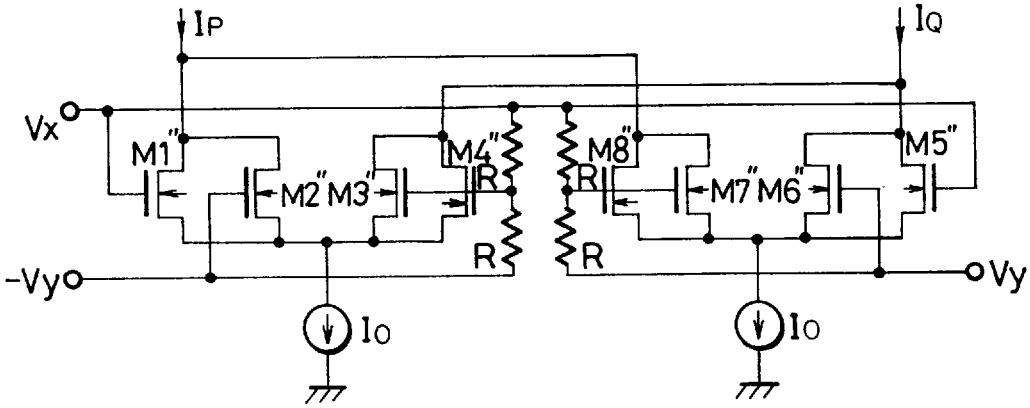
FIG. 7 PRIOR ART
FIG. 7 is a circuit diagram showing a second example of the prior-art multipliers.
Figure 10:
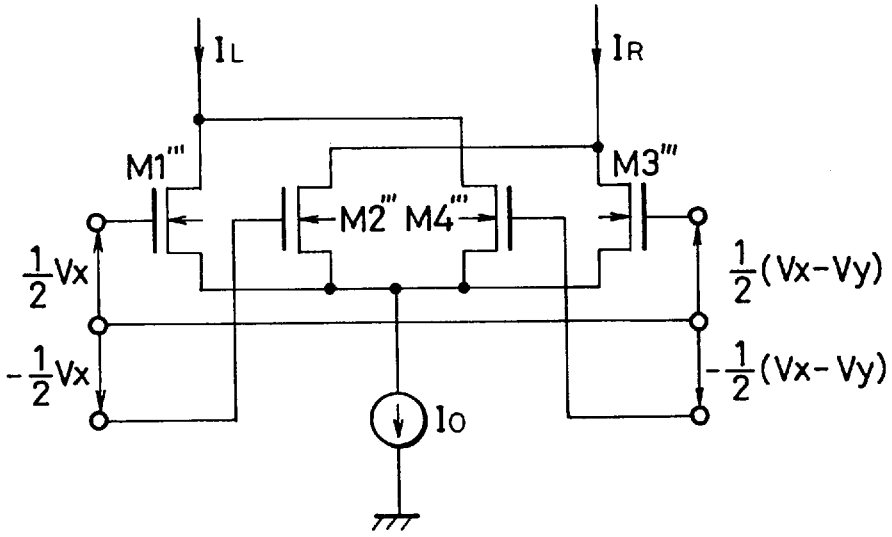
FIG. 10 PRIOR ART
FIG. 10 is a circuit diagram showing a third example of the prior-art multipliers.
Figure 8:
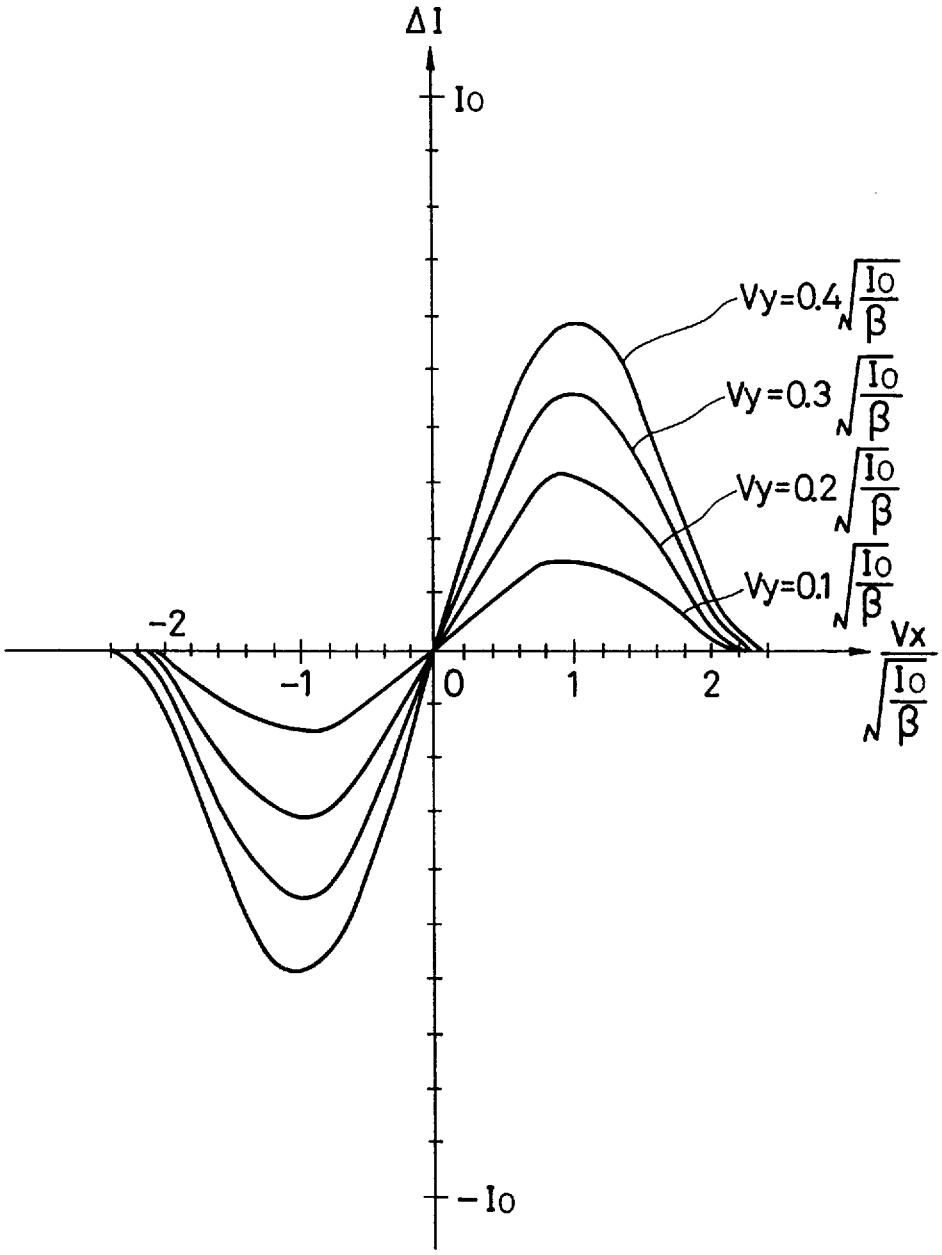
FIG. 8 PRIOR ART
FIG. 8 shows the transfer characteristics of the prior-art multiplier shown in FIG. 7.
Figure 9:
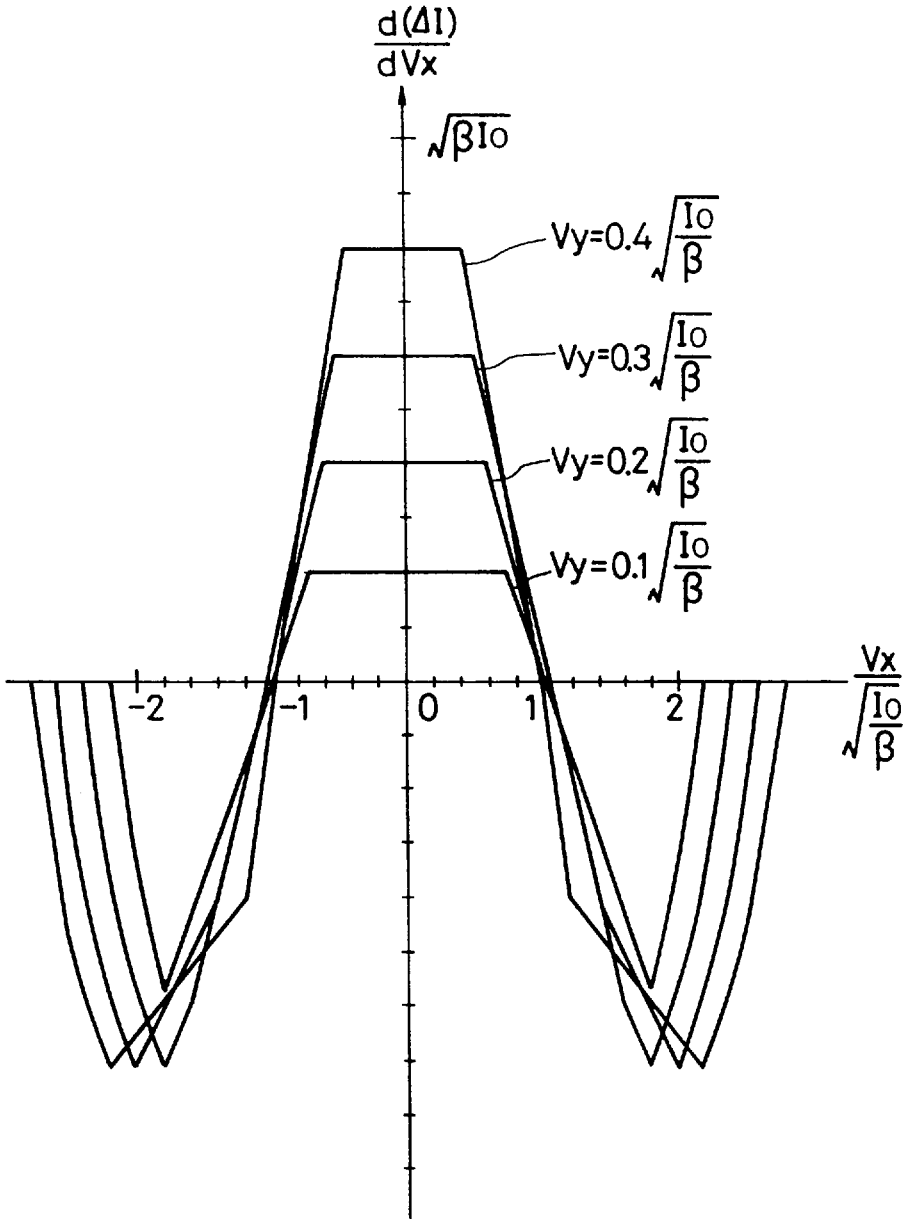
FIG. 9 PRIOR ART
FIG. 9 shows the output characteristics of the prior-art multiplier shown in FIG. 7.
Figure 11:
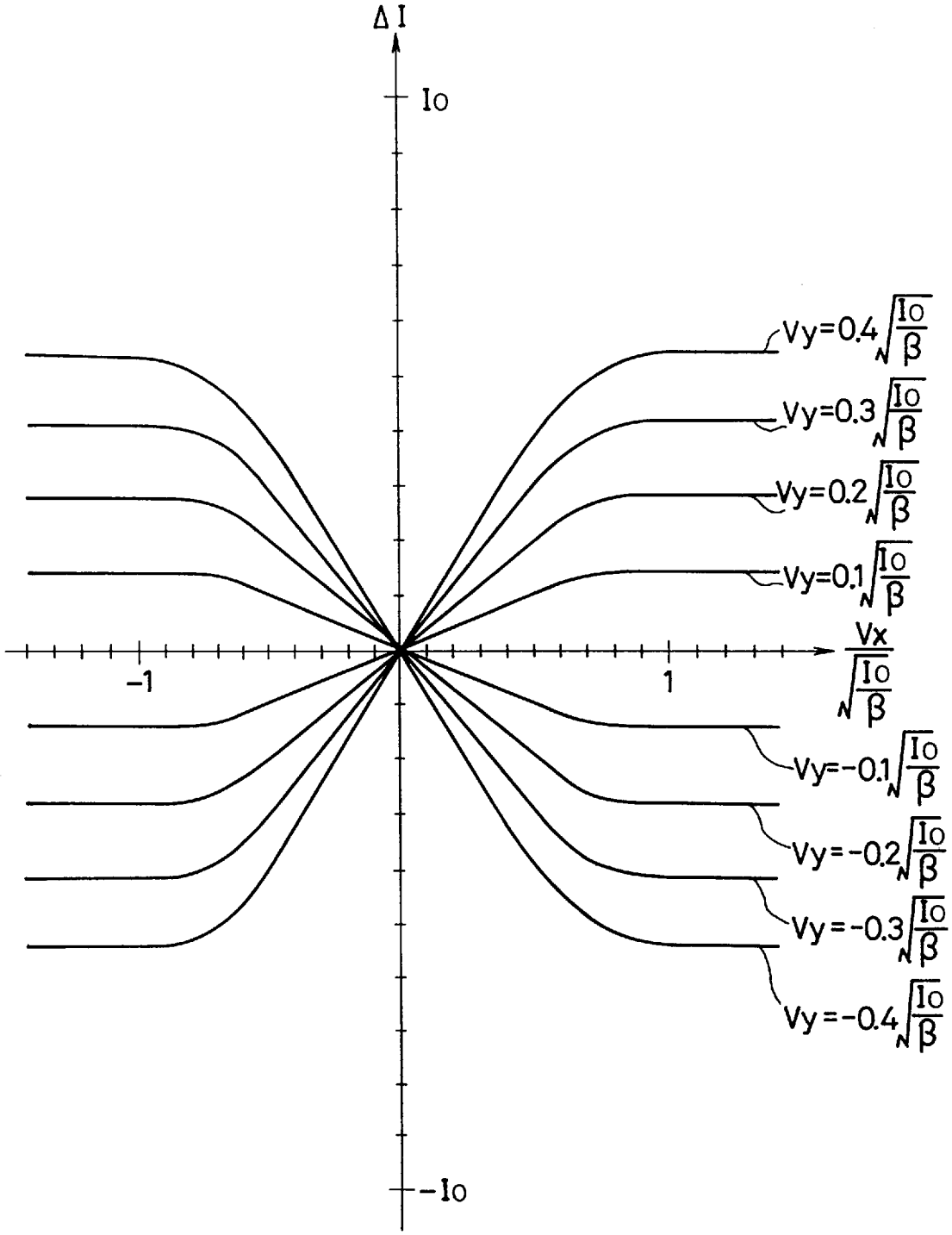
FIG. 11 PRIOR ART
FIG. 11 shows the transfer characteristics of the prior-art multiplier shown in FIG. 10.
Figure 12:
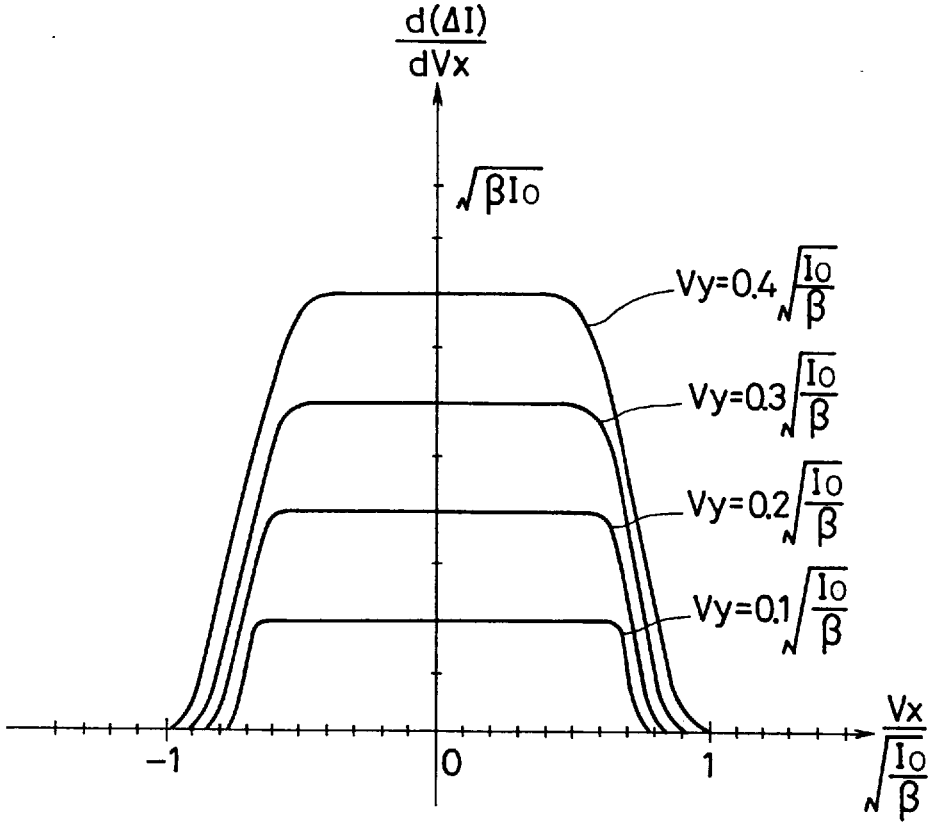
FIG. 12 PRIOR ART
FIG. 12 shows the output characteristics of the prior-art multiplier shown in FIG. 10.

As seen from FIGS. 14 and 15, the second input voltage $V_y$ is wider in superiorly linear range while the first input voltage $V_x$ is substantially equal in superiorly linear range to that in FIG. 2. This means that the multiplier of the first embodiment is improved in a superiorly linear range of the second input voltage $V_y$.

The transconductance characteristics of the multiplier can be given by differentiating the differential output current $\Delta I_B$ by the first or second input voltage $V_x$ or $V_y$ in the equation 6 as shown in the following equations 7 and 8, respectively.

$$\frac{d(\Delta I_B)}{dV_x} = \frac{\alpha_F I_0}{V_T}\left[\frac{\cosh\left(\frac{V_x}{2V_T}\right)\sinh\left(\frac{V_y}{2V_T}\right)}{\left\{\cosh\left(\frac{V_x}{2V_T}\right)+\exp\left(\frac{V_y}{2V_T}\right)\right\}\left\{\cosh\left(\frac{V_x}{2V_T}\right)+\exp\left(-\frac{V_y}{2V_T}\right)\right\}} - \frac{2\sinh^2\left(\frac{V_x}{2V_T}\right)\sinh\left(\frac{V_y}{2V_T}\right)\left\{\cosh\left(\frac{V_x}{2V_T}\right)+\cosh\left(\frac{V_y}{2V_T}\right)\right\}}{\left\{\cosh\left(\frac{V_x}{2V_T}\right)+\exp\left(\frac{V_y}{2V_T}\right)\right\}^2\left\{\cosh\left(\frac{V_x}{2V_T}\right)+\exp\left(-\frac{V_y}{2V_T}\right)\right\}^2}\right] \tag{7}$$

$$\frac{d(\Delta I_B)}{dV_y} = \frac{\alpha_F I_0}{V_T}\left[\frac{\cosh\left(\frac{V_x}{2V_T}\right)\sinh\left(\frac{V_y}{2V_T}\right)}{\left\{\cosh\left(\frac{V_x}{2V_T}\right)+\exp\left(\frac{V_y}{2V_T}\right)\right\}\left\{\cosh\left(\frac{V_x}{2V_T}\right)+\exp\left(-\frac{V_y}{2V_T}\right)\right\}} + \frac{\sinh\left(\frac{V_x}{2V_T}\right)\sinh^2\left(\frac{V_y}{2V_T}\right)}{\left\{\cosh\left(\frac{V_x}{2V_T}\right)+\exp\left(\frac{V_y}{2V_T}\right)\right\}^2\left\{\cosh\left(\frac{V_x}{2V_T}\right)+\exp\left(-\frac{V_y}{2V_T}\right)\right\}^2}\right] \tag{8}$$

Figure 16:
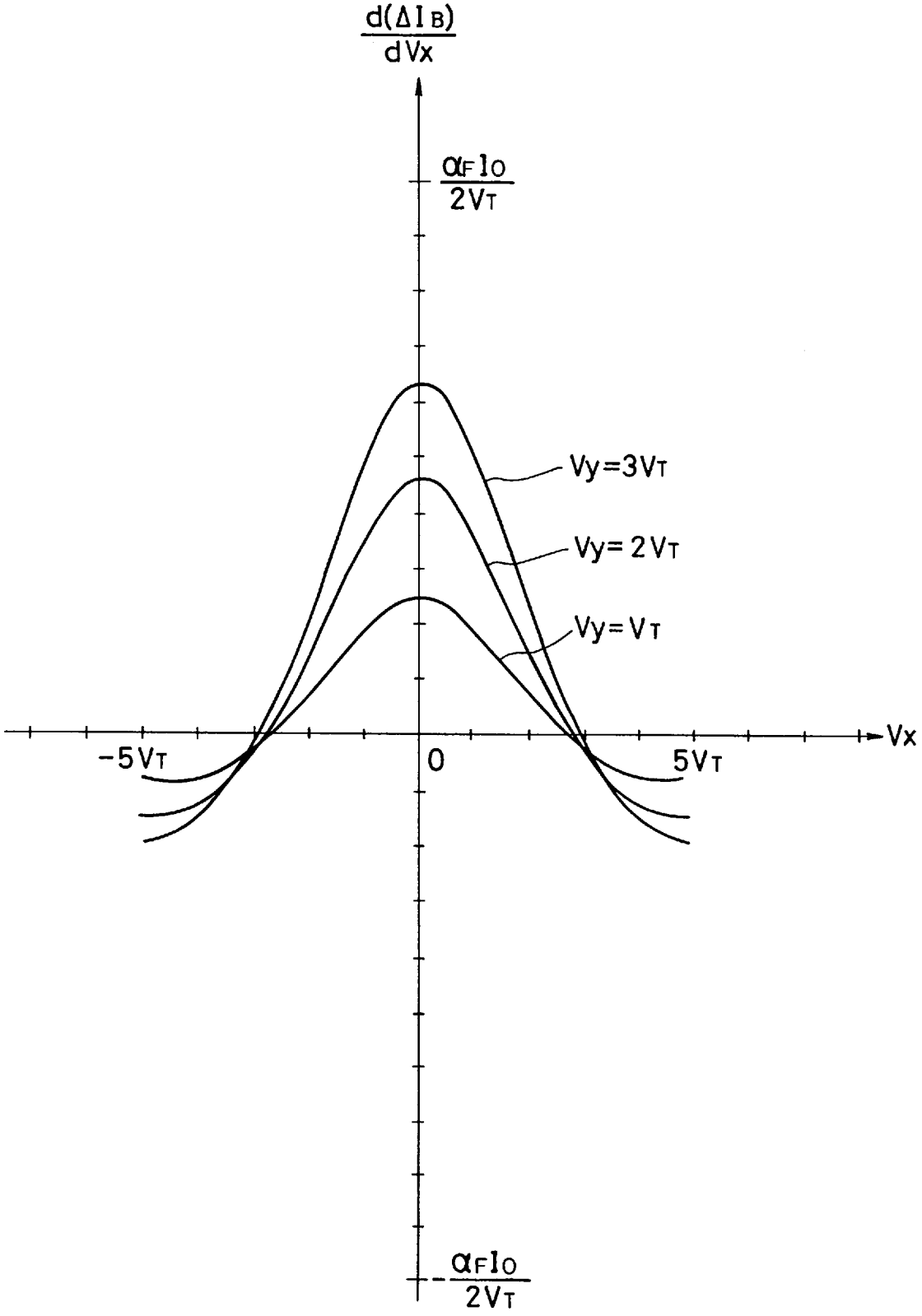
FIG. 16 shows the transconductance characteristics of the multiplier of the first embodiment shown in FIG. 13, in which the relationship between the transconductance ($d\Delta I_B/dV_x$) and the first input voltage $V_x$ with the second input voltage $V_y$ as a parameter.
Figure 17:
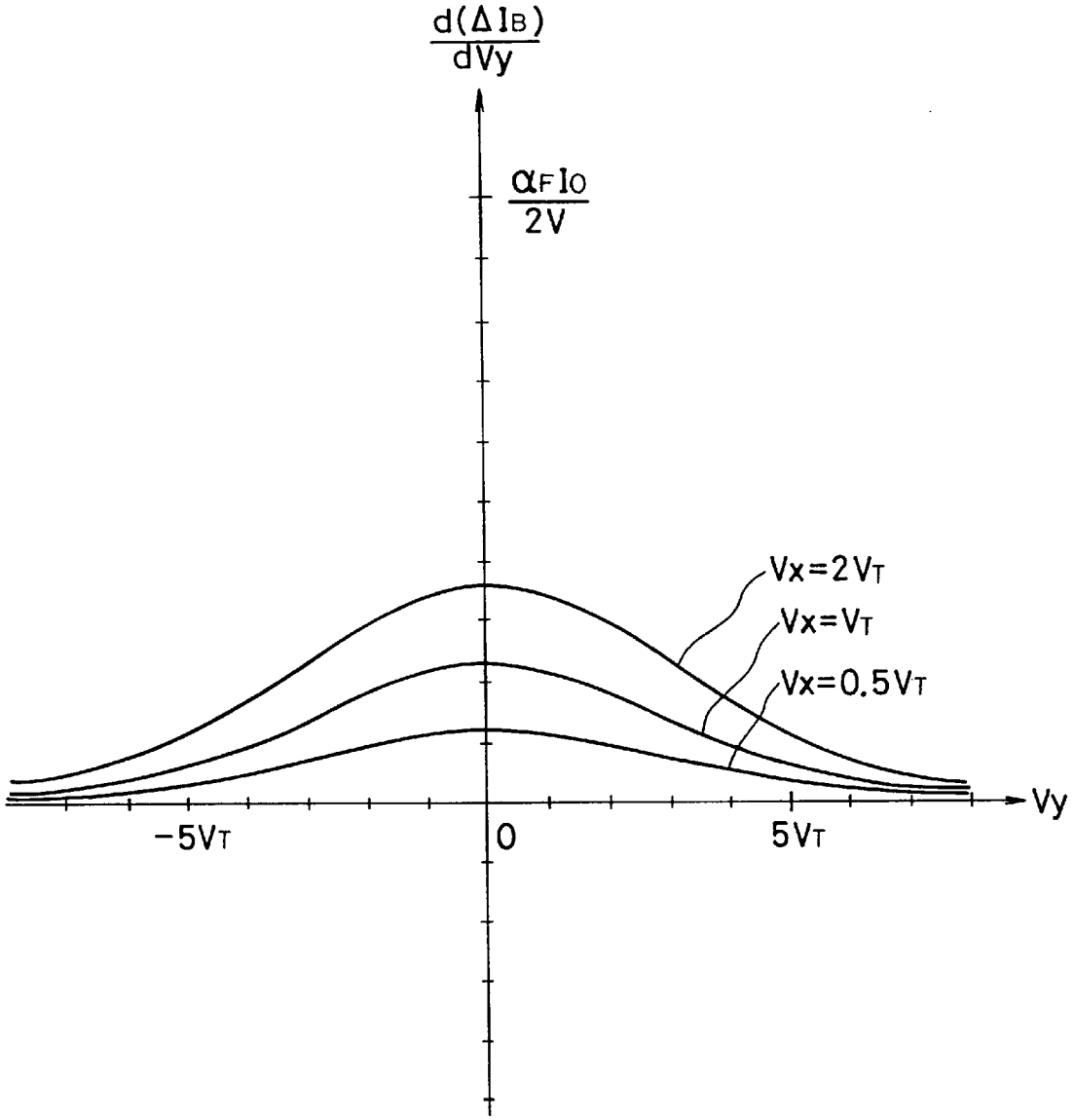
FIG. 17 shows the transconductance characteristics of the multiplier of the first embodiment shown in FIG. 13, in which the relationship between the transconductance ($d\Delta I_B/dV_y$) and the second input voltage $V_y$ with the first input voltage $V_x$ as a parameter.

The transconductance characteristics obtained from the equations 7 and 8 are shown in FIGS. 16 and 17. FIG. 16 shows the relationship between the transconductance and the first input voltage $V_x$ with the second input voltage $V_y$ as a parameter. FIG. 17 shows the relationship between the transconductance and the second input voltage $V_y$ with the first input voltage $V_x$ as a parameter.

[Second Embodiment]

Figure 18:
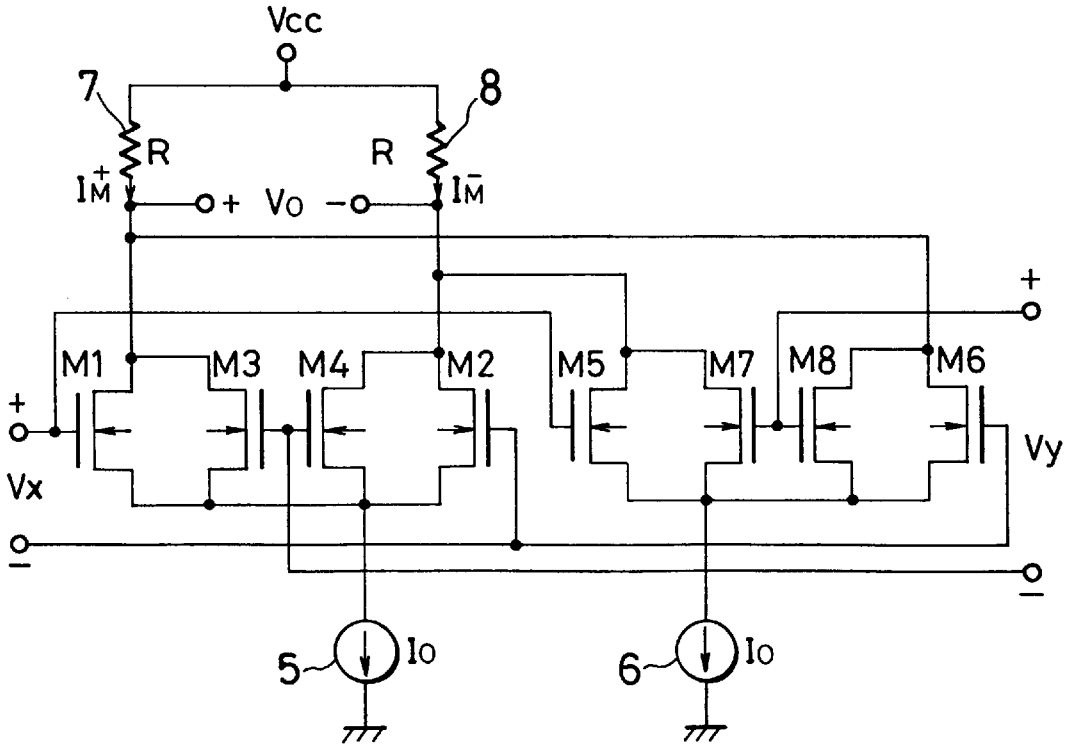
FIG. 18 is a circuit diagram of a multiplier according to a second embodiment of the present invention.

FIG. 18 shows a multiplier according to a second embodiment of the present invention, which is equivalent to a circuit obtained by replacing the bipolar transistors Q1, Q2, Q3, Q4, Q5, Q6, Q7 and Q8 with MOS transistors M1, M2, M3, M4, M5, M6, M7 and M8, respectively.

In FIG. 18, the MOS transistors M1, M2, M3 and M4 and a first constant current source 5 (current: $I_0$) for driving the transistors M1, M2, M3 and M4 constitute a first quadritail cell, and four MOS transistors M5, M6, M7 and M8 and a second constant current source 6 (current: $I_0$) for driving the transistors M5, M6, M7 and M8 constitute a second quadritail cell. These eight transistors M1, M2, M3, M4, M5, M6, M7 and M8 have the same capacity or a ratio (W/L) of a gate-width W and a gate-length L.

In the first quadritail cell, the transistors M1 and M3 compose a first pair whose output ends or drains are coupled together, and the transistors M2 and M4 compose a second pair whose output ends or drains are coupled together. Sources of the transistors M1, M2, M3 and M4 are connected in common to the first constant current source 5. Gates of the transistors M3 and M4 are coupled together.

A first input voltage $V_x$ to be multiplied is applied across gates of the transistors M1 and M2. A second input voltage $V_y$ to be multiplied is applied to the gates coupled together of the transistors M3 and M4 in negative phase.

In the second quadritail cell, the transistors M5 and M7 compose a third pair whose output ends or drains are coupled together, and the transistors M6 and M8 compose a fourth pair whose output ends or drains are coupled together. Sources of the transistors M5, M6, M7 and M8 are connected in common to the second constant current source 6. Gates of the transistors M7 and M8 are coupled together.

The first input voltage $V_x$ is applied across gates of the transistors M5 and M6. The second input voltage $V_y$ is applied to the gates coupled together of the transistors M7 and M8 in positive phase.

Between the first and second quadritail circuits, the drains coupled together of the transistors M1 and M3 and the drains coupled together of the transistors M6 and M8 are further coupled together to form one of differential output ends of the multiplier. The drains coupled together of the transistors M2 and M4 and the drains of the transistors M5 and M7 are further coupled together to form the other of the differential output ends.

In other words, the output end of the first pair of the transistors M1 and M3 and that of the fourth pair of the transistors M6 and M8, which are in opposite phase to each other, are coupled together. Similarly, the output end of the second pair of the transistors M2 and M4 and that of the third pair of the transistors M5 and M7, which are in opposite phase to each other, are coupled together. This means that the output ends of the first and fourth pairs are cross-coupled, and those of the second and third pairs are also cross-coupled.

Load resistors (resistance: $R_L$) 7 and 8 are connected to the differential output ends of the multiplier, respectively. A power source voltage $V_{CC}$ is applied through the load resistor 7 to the first and fourth pairs, and is applied through the load resistor 8 to the second and third pairs.

The second input voltage $V_y$ is applied across the gates coupled together of the transistors M7 and M8 and the gates coupled together of the transistors M3 and M4.

With the multiplier of the second embodiment, we suppose that the transistors M1, M2, M3, M4, M5, M6, M7 and M8 are matched in characteristic and operating in the saturation regions, and the channel-length modulation can be ignored. Also, we suppose that drain currents of these transistors and gate-source voltages thereof have the square-law characteristics, respectively.

The drain currents $I_{D1}$, $I_{D2}$, $I_{D3}$ and $I_{D4}$ of the transistors M1, M2, M3 and M4 of the first quadritail cell can be expressed as the following equations 9, 10 and 11, respectively.

$$I_{D1} = \beta\left(V_R - V_A + \frac{1}{2}V_x - V_{TH}\right)^2 \left(V_R - V_A + \frac{1}{2}V_X \geqq V_{TH}\right) \tag{9}$$

$$I_{D2} = \beta\left(V_R - V_A + \frac{1}{2}V_x - V_{TH}\right)^2 \left(V_R - V_A + \frac{1}{2}V_Y \geqq V_{TH}\right) \tag{10}$$

$$I_{D3} = I_{D4} = \beta\left(V_R - V_A - \frac{1}{2}V_y - V_{TH}\right)^2 \left(V_R - V_A - \frac{1}{2}V_Y \geqq V_{TH}\right) \tag{11}$$

In the equations 9, 10 and 11, β is the transconductance parameter of these MOS transistors. Here, β is expressed as $\mu(C_{OX}/2)(W/L)$ where $\mu$ is the effective carrier mobility, $C_{OX}$ is the gate oxide capacitance per unit area, and W and L are a gate-width and a gate-length of these transistors, respectively. Also, $V_{TH}$ is the threshold voltage and $V_R$ is a dc component of the first input voltage $V_x$, and $V_A$ is the common source voltage of the transistors of the first quadritail cell.

A tail current of the first quadritail cell is expressed as the following equation 12.

$$I_{D1}+I_{D2}+I_{D3}+I_{D4}=I_0 \tag{12}$$

Similarly, the same equations are obtained about the transistors M5, M6, M7 and M8 of the second quadritail cell, so that a differential output current $\Delta I_M$ is given as the following equation 13, 14, 15, 16, 17 and 18, where $I_{D1}$, $I_{D2}$, $I_{D3}$ and $I_{D4}$ are drain currents of the transistors M5, M6, M7 and M8.

$$\begin{aligned}\Delta I_M &= I_M^+ - I_M^- \\ &= (I_{D1}+I_{D3}+I_{D6}+I_{D8}) - (I_{D2}+I_{D4}+I_{D5}+I_{D7}) \\ &= \beta V_x V_y \\ &\left(|V_x| \leqq -\frac{|V_y|}{3} + \sqrt{\frac{2I_0}{3\beta} - \frac{2}{9}V_y^2},\ |V_x| \leqq \sqrt{\frac{2I_0}{\beta} - V_y^2}\right)\end{aligned} \tag{13}$$

$$\begin{aligned}\Delta I_M &= I_M^+ - I_M^- \\ &= (I_{D1}+I_{D3}+I_{D6}+I_{D8}) - (I_{D2}+I_{D4}+I_{D5}+I_{D7}) \\ &= \frac{4}{9}\beta V_x V_y + \left\{\frac{1}{9}\beta(2|V_x|+|V_y|)\sqrt{\frac{12I_0}{\beta} - 2(|V_x|-|V_y|)^2} - \frac{I_0}{3} - \frac{7}{18}\beta V_x^2 - \frac{1}{18}\beta V_y^2\right\} sgn(V_xV_y) \\ &\left(|V_x| \leqq \sqrt{\frac{2I_0}{2\beta} - \frac{2}{9}V_y^2},\ -\frac{|V_y|}{3} + \sqrt{\frac{2I_0}{3\beta} - \frac{2}{9}V_y^2} \leqq |V_x| \leqq \frac{|V_y|}{3} + \sqrt{\frac{2I_0}{3\beta} - \frac{2}{9}V_y^2}\right)\end{aligned} \tag{14}$$

$$\begin{aligned}\Delta I_M &= I_M^+ - I_M^- \\ &= (I_{D1}+I_{D3}+I_{D6}+I_{D8}) - (I_{D2}+I_{D4}+I_{D5}+I_{D7}) \\ &= \frac{7}{36}\beta V_x V_y + \left\{-\frac{I_0}{12} - \frac{19}{72}\beta V_x^2 - \frac{1}{18}V_y^2 + \frac{1}{9}\beta(2|V_x|+|V_y|)\sqrt{\frac{12I_0}{\beta} - 2(|V_x|-|V_y|)^2} - \frac{1}{8}\beta(2|V_x|-|V_y|)\sqrt{\frac{4I_0}{\beta} - 2V_x^2 - V_y^2}\right\} sgn(V_xV_y) \\ &\left(\frac{|V_y|}{3} + \sqrt{\frac{2I_0}{3\beta} - \frac{2}{9}V_y^2} \leqq |V_x| \leqq \sqrt{\frac{2I_0}{\beta} - V_y^2},\ |V_y| \leqq |V_x|\right)\end{aligned} \tag{15}$$

$$\begin{aligned}\Delta I_M &= I_M^+ - I_M^- \\ &= (I_{D1}+I_{D3}+I_{D6}+I_{D8}) - (I_{D2}+I_{D4}+I_{D5}+I_{D7}) \\ &= \frac{1}{9}\beta V_x V_y + \left\{\frac{5}{18}\beta V_x^2 - \frac{1}{18}\beta V_y^2 + \frac{2}{3}I_0 - \frac{1}{18}\beta(|V_x|-|V_y|) \times \sqrt{\frac{12I_0}{\beta} - 2(|V_x|-|V_y|)^2}\right\} sgn(V_xV_y)\end{aligned} \tag{16}$$

-continued $$\left(\frac{|V_y|}{3}+\sqrt{\frac{2I_0}{3\beta}-\frac{2}{9}V_y^2}\leqq|V_y|,\ \sqrt{\frac{2I_0}{\beta}-V_y^2}\leqq|V_x|,|V_y|\leqq|V_x|\right)$$

$$\begin{aligned}\Delta I_M &= I_M^+ - I_M^- \\ &= (I_{D1}+I_{D3}+I_{D6}+I_{D8})-(I_{D2}+I_{D4}+I_{D5}+I_{D7}) \\ &= \frac{1}{2}\beta V_xV_y+\beta V_x\left(\sqrt{\frac{2I_0}{\beta}-V_x^2}-\frac{1}{2}\sqrt{\frac{4I_0}{\beta}-2V_x^2-V_y^2}\right)sgn(V_y)\end{aligned} \tag{17}$$

$$\left(\sqrt{\frac{2I_0}{\beta}-V_y^2}\leqq|V_x|\leqq\frac{|V_y|}{3}+\sqrt{\frac{2I_0}{3\beta}-\frac{2}{9}V_y^2},|V_x|\leqq|V_y|,|V_x|\leqq\sqrt{\frac{I_0}{\beta}}\right)$$

$$\begin{aligned}\Delta I_M &= I_M^+ - I_M^- \\ &= (I_{D1}+I_{D3}+I_{D6}+I_{D8})-(I_{D2}+I_{D4}+I_{D5}+I_{D7}) \\ &= \frac{1}{2}\beta V_xV_y+I_0sgn(V_xV_y)-\left(\frac{1}{2}\beta V_x\sqrt{\frac{4I_0}{\beta}-2V_x^2-V_y^2}\right)sgn(V_y)\end{aligned} \tag{18}$$

$$\left(\sqrt{\frac{2I_0}{\beta}-V_y^2}\leqq|V_x|\leqq\frac{|V_y|}{3}+\sqrt{\frac{2I_0}{3\beta}-\frac{2}{9}V_y^2},\sqrt{\frac{I_0}{\beta}}\leqq|V_x|\leqq|V_y|\right)$$

From the equations 13 to 18, it is seen that when each of the MOS transistors has the square-law characteristic, the multiplier of the second embodiment has an ideal multiplication characteristic within the input voltage ranges where all of the MOS transistors M1 to M8 do not cut-off. It is also seen that the multiplication characteristic of the multiplier deviates from the ideal one according to increase of the input voltages due to cut-off of the transistors.

Figure 19:
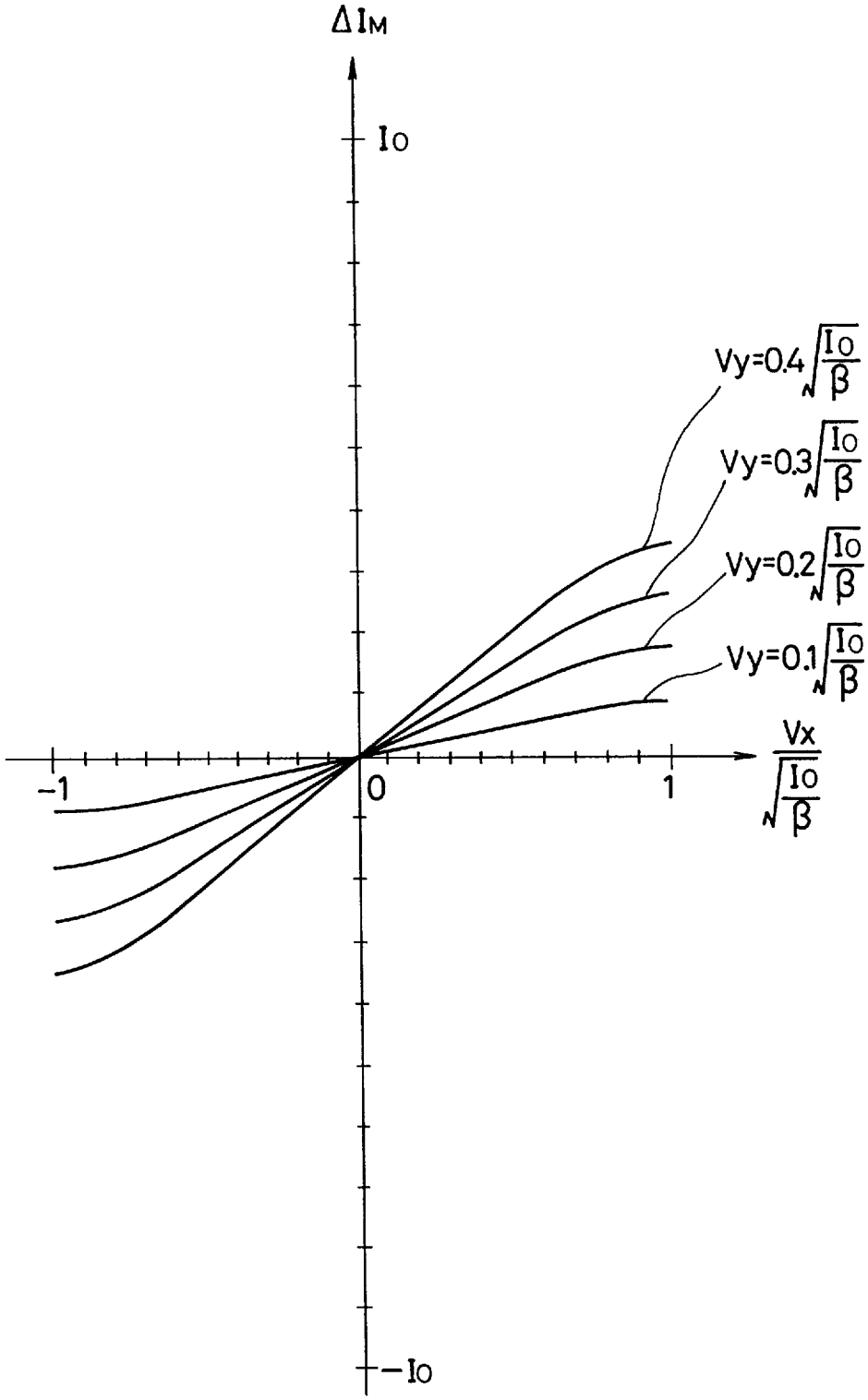
FIG. 19 shows the transfer characteristics of the multiplier of the second embodiment shown in FIG. 18, in which the relationship between the differential output current $\Delta I_M$ and the first input voltage $V_x$ is shown with the second input voltage $V_y$ as a parameter.
Figure 20:
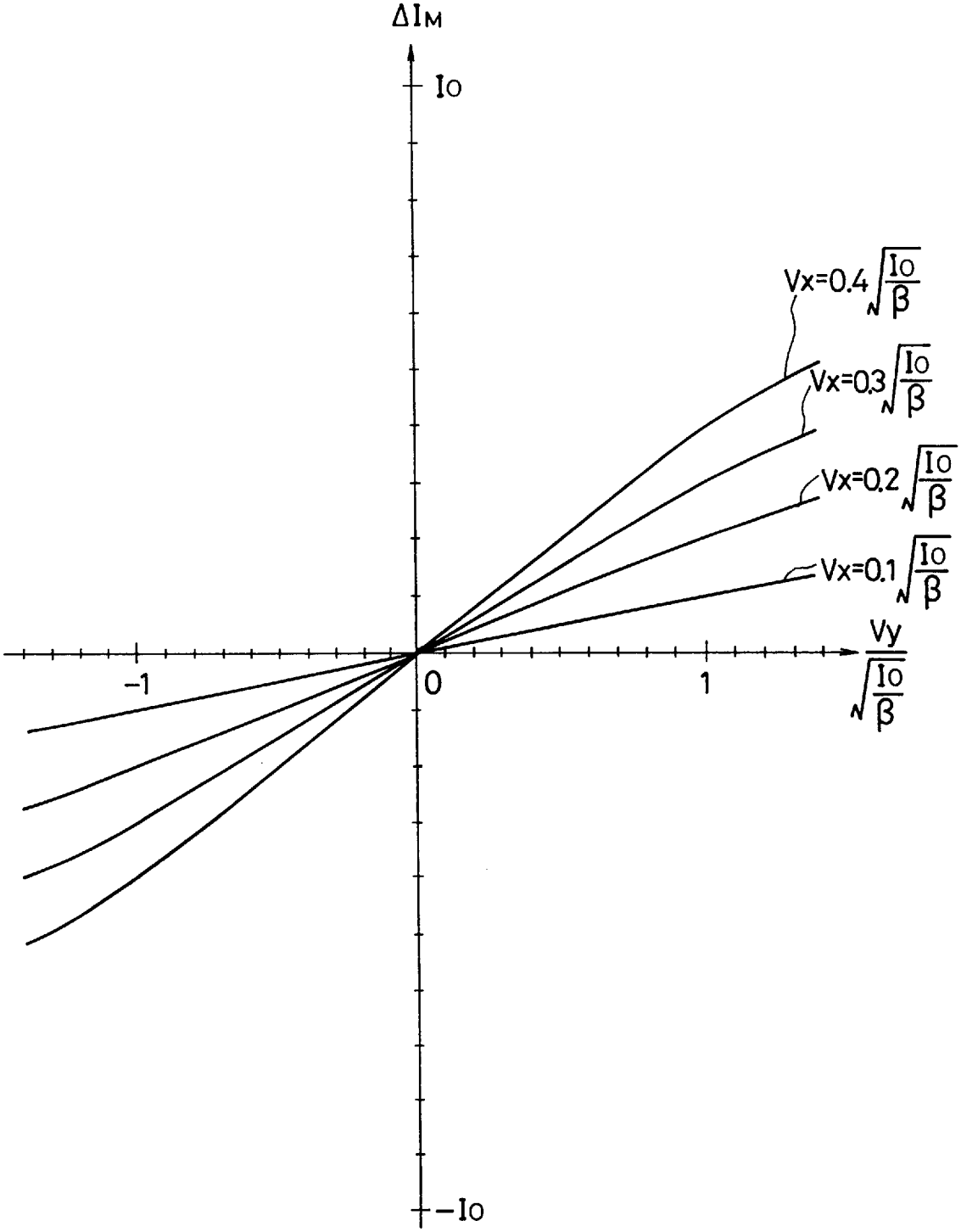
FIG. 20 shows the transfer characteristics of the multiplier of the second embodiment shown in FIG. 18, in which the relationship between the differential output current $\Delta I_M$ and the second input voltage $V_y$ is shown with the first input voltage $V_x$ as a parameter.
Figure 21:
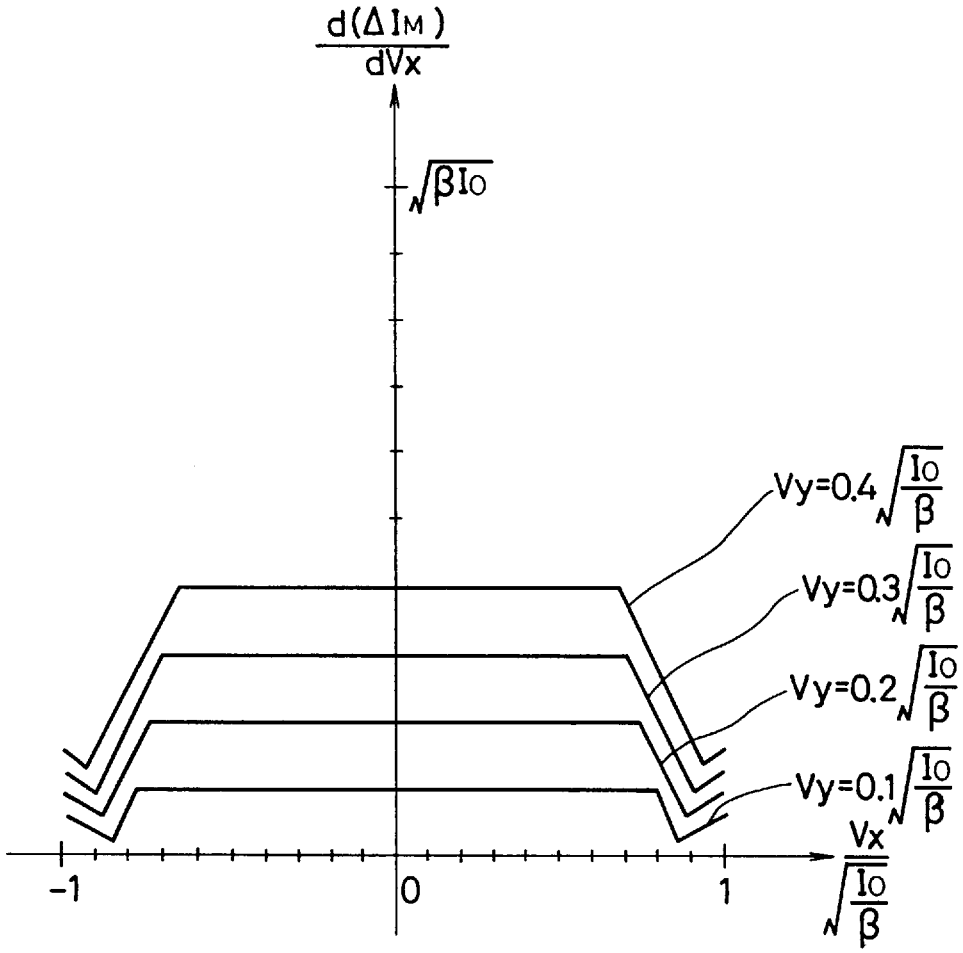
FIG. 21 shows the transconductance characteristics of the multiplier of the second embodiment shown in FIG. 18, in which the relationship between the transconductance ($d\Delta I_M/dV_x$) and the first input voltage $V_x$ with the second input voltage $V_y$ as a parameter.
Figure 22:
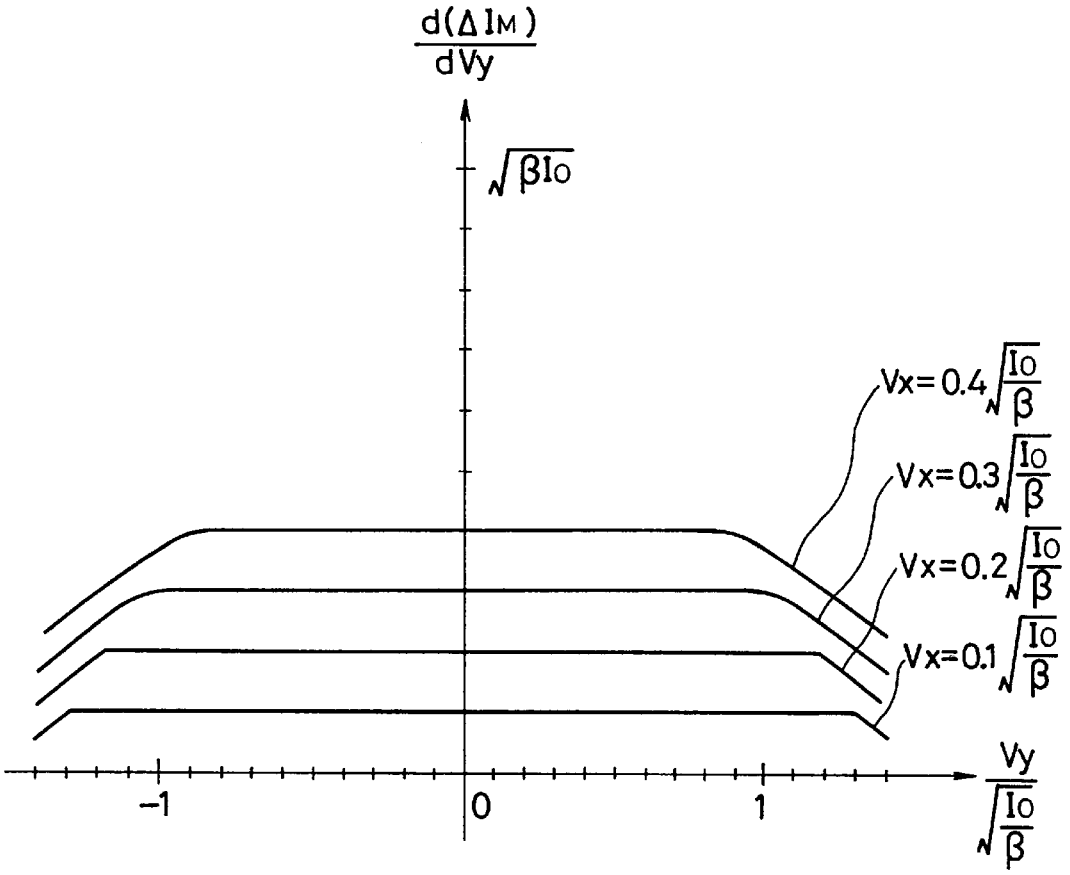
FIG. 22 shows the transconductance characteristics of the multiplier of the second embodiment shown in FIG. 18, in which the relationship between the transconductance ($d\Delta I_M/dV_y$) and the second input voltage $V_y$ with the first input voltage $V_x$ as a parameter.

The transfer characteristics of the multiplier of the second embodiment concerning the first and second input voltage $V_x$ and $V_y$ are shown in FIGS. 19 and 20, respectively, which are obtained from the equations 13 to 18. FIG. 19 shows the relationship between the differential output current $\Delta I_M$ and the first input voltage $V_x$ with the second input voltage $V_y$ as a parameter. FIG. 20 shows the relationship between the differential output current $\Delta I_M$ and the second input voltage $V_y$ with the first input voltage $V_x$ as a parameter. In FIGS. 19 and 20, the input voltages $V_x$ and $V_y$ are normalized by $(I_0/\beta)^{1/2}$.

As seen from FIGS. 19 and 20, both of the first and second input voltages $V_x$ and $V_y$ are remarkably wide in superiorly linear range. The superiorly linear range of the second input voltage $V_y$ exceeds one (1) in normalized value, or $(I_0/\beta)^{1/2}$, which is especially improved. This means that the first and second input voltage ranges can be largely improved in the multiplier of the second embodiment.

The equations (19) to (24) are obtained by differentiating the differential current $\Delta I_M$ by the voltage $V_x$ to obtain the transconductance characteristic for $V_x$. The equations (25) to (29) are obtained by differentiating the differential current $\Delta I_M$ by the voltage $V_y$ to obtain the transconductance characteristic for $V_y$. These equations are applied for different input voltage ranges.

$$\frac{d(\Delta I_M)}{dV_x}=\beta V_y \tag{19}$$

$$\left(|V_x|\leqq-\frac{|V_y|}{3}+\sqrt{\frac{2I_0}{3\beta}-\frac{2}{9}V_y^2},|V_x|\leqq\sqrt{\frac{2I_0}{\beta}-V_y^2}\right)$$

$$\frac{d(\Delta I_M)}{dV_x}=\frac{4}{9}\beta V_y-\left\{-\frac{7}{9}\beta|V_x|+\frac{2}{9}\beta\sqrt{\frac{12I_0}{\beta}-2(|V_x|-|V_y|)^2}-\frac{2}{9}\frac{\beta(2V_x^2-V_y^2-|V_y||V_x|)}{\sqrt{\frac{12I_0}{\beta}-2(|V_x|-|V_y|)^2}}\right\}sgn(V_y) \tag{20}$$

$$\left(|V_x|\leqq\sqrt{\frac{2I_0}{\beta}-V_y^2},\ -\frac{|V_y|}{3}+\sqrt{\frac{2I_0}{3\beta}-\frac{2}{9}V_y^2}\leqq|V_x|\leqq\frac{|V_y|}{3}+\sqrt{\frac{2I_0}{3\beta}-\frac{2}{9}V_y^2}\right)$$

$$\frac{d(\Delta I_M)}{dV_x}=\frac{7}{36}\beta V_y+\left\{-\frac{19}{36}\beta|V_x|+\frac{2}{9}\beta\sqrt{\frac{12I_0}{\beta}-2(|V_x|-|V_y|)^2}-\frac{2}{9}\frac{\beta(2V_x^2-V_y^2-|V_y||V_x|)}{\sqrt{\frac{12I_0}{\beta}-2(|V_x|-|V_y|)^2}}-\frac{1}{4}\beta\sqrt{\frac{4I_0}{\beta}-2V_x^2-V_y^2}+\frac{1}{4}\frac{\beta(2V_x^2-|V_x||V_y|)}{\sqrt{\frac{4I_0}{\beta}-2V_x^2-V_y^2}}\right\}sgn(V_y) \tag{21}$$

$$\left(\frac{|V_x|}{3}+\sqrt{\frac{2I_0}{\beta}-\frac{2}{9}V_y^2}\leqq|V_x|\leqq\sqrt{\frac{2I_0}{\beta}-V_y^2},|V_y|\leqq|V_x|\right)$$

$$\frac{d(\Delta I_M)}{dV_x}=\frac{1}{9}\beta V_y+\frac{5}{9}\beta|V_x|+\frac{1}{9}\frac{\beta(|V_x|-|V_y|)^2}{\sqrt{\frac{12I_0}{\beta}-2(|V_x|-|V_y|)^2}}-\frac{1}{18}\beta\left\{\sqrt{\frac{12I_0}{\beta}-2(|V_x|-|V_y|)^2}\right\}sgn(V_y) \tag{22}$$

-continued $$\left(\frac{|V_x|}{3}+\sqrt{\frac{2I_0}{\beta}-\frac{2}{9}V_y^2}\leqq|V_x|,\ \sqrt{\frac{2I_0}{3\beta}-V_y^2}\leqq|V_x|,|V_y|\leqq|V_x|\right)$$

$$\frac{d(\Delta I_M)}{dV_x}=\frac{1}{2}\beta V_y+\beta\left(\sqrt{\frac{2I_0}{\beta}-V_x^2}-\frac{1}{2}\sqrt{\frac{4I_0}{\beta}-2V_x^2-V_y^2}\right)sgn(V_y)-\left\{\frac{\beta V_x^2}{\sqrt{\frac{2I_0}{\beta}-V_x^2}}-\frac{\beta V_x^2}{\sqrt{\frac{4I_0}{\beta}-2V_x^2-V_y^2}}\right\}sgn(Vy)\quad(23)$$

$$\left(\sqrt{\frac{2I_0}{\beta}-V_y^2}\leqq|V_x|\leqq\frac{|V_y|}{3}+\sqrt{\frac{2I_0}{3\beta}-\frac{2}{9}V_y^2},\ |V_x|\leqq|V_y|,|V_x|\leqq\sqrt{\frac{I_0}{\beta}}\right)$$

$$\frac{d(\Delta I_M)}{dV_x}=\frac{1}{2}\beta V_y-\left(\frac{1}{2}\beta\sqrt{\frac{4I_0}{\beta}2V_x^2-V_y^2}+\frac{\beta V_x^2}{\sqrt{\frac{4I_0}{\beta}-2V_x^2-V_y^2}}\right)sgn(V_y)\quad(24)$$

$$\left(\sqrt{\frac{2I_0}{\beta}-V_y^2}\leqq|V_x|\leqq\frac{|V_y|}{3}+\sqrt{\frac{2I_0}{3\beta}-\frac{2}{9}V_y^2},\sqrt{\frac{I_0}{\beta}}\leqq|V_x|\leqq|V_y|\right)$$

$$\frac{d(\Delta I_M)}{dV_y}=\beta V_x\quad(25)$$

$$\left(|V_y|\leqq-|V_x|+\sqrt{\frac{2I_0}{\beta}-3V_x^2},|V_y|\leqq\sqrt{\frac{2I_0}{\beta}-V_x^2}\right)$$

$$\frac{d(\Delta I_M)}{dV_y}=\frac{4}{9}\beta V_x+\left\{-\frac{1}{9}\beta|V_y|+\frac{1}{9}\beta\sqrt{\frac{12I_0}{\beta}-2(|V_x|-|V_y|)^2}+\frac{2}{9}\frac{\beta(2V_x^2-V_y^2-|V_y||V_x|)}{\sqrt{\frac{12I_0}{\beta}-2(|V_x|-|V_y|)^2}}\right\}sgn(V_x)\quad(26)$$

$$\left(|V_y|\leqq\sqrt{\frac{2I_0}{\beta}-V_x^2},\ -|V_x|+\sqrt{\frac{2I_0}{\beta}-3V_x^2}\leqq|V_y|\leqq|V_x|+\sqrt{\frac{2I_0}{\beta}-3V_x^2}\right)$$

-continued $$\frac{d(\Delta I_M)}{dV_y}=\frac{7}{36}\beta V_x-\left\{\frac{1}{9}\beta|V_x|-\frac{1}{9}\beta\sqrt{\frac{12I_0}{\beta}-2(|V_x|-|V_y|)^2}-\frac{2}{9}\frac{\beta(2V_x^2-V_y^2-|V_y||V_x|)}{\sqrt{\frac{12I_0}{\beta}-2(|V_x|-|V_y|)^2}}-\frac{1}{8}\beta\sqrt{\frac{4I_0}{\beta}-2V_x^2-V_y^2}-\frac{1}{8}\frac{\beta(2|V_x||V_y|-V_y^2)}{\sqrt{\frac{4I_0}{\beta}-2V_x^2-V_y^2}}\right\}sgn(V_x)\quad(27)$$

$$\left(|V_x|+\sqrt{\frac{2I_0}{3\beta}-3V_x^2}\leqq|V_y|,\sqrt{\frac{2I_0}{5\beta}-V_x^2}\leqq|V_y|\right)$$

$$\frac{d(\Delta I_M)}{dV_y}=\frac{1}{9}\beta V_x-\frac{1}{9}\beta|V_y|-\frac{1}{9}\frac{\beta(|V_x|-|V_y|)^2}{\sqrt{\frac{12I_0}{\beta}-2(|V_x|-|V_y|)^2}}+\frac{1}{18}\beta\left\{\sqrt{\frac{12I_0}{\beta}-2(|V_x|-|V_y|)^2}\right\}sgn(V_x)\quad(28)$$

$$\left(|V_x|+\sqrt{\frac{2I_0}{\beta}-3V_x^2}\leqq|V_y|,\sqrt{\frac{2I_0}{\beta}-V_x^2}\leqq|V_y|,|V_y|\leqq|V_x|\right)$$

$$\frac{d(\Delta I_M)}{dV_y}=\frac{1}{4}\beta V_x+\frac{1}{4}\frac{\beta V_x|V_y|}{\sqrt{\frac{4I_0}{\beta}-2V_x^2-V_y^2}}\quad(29)$$

$$\left(\sqrt{\frac{2I_0}{5\beta}-V_x^2}\leqq|V_y|\leqq|V_x|+\sqrt{\frac{2I_0}{\beta}-3V_x^2},|V_x|\leqq|V_y|\right)$$

[Third Embodiment]

Figure 23:
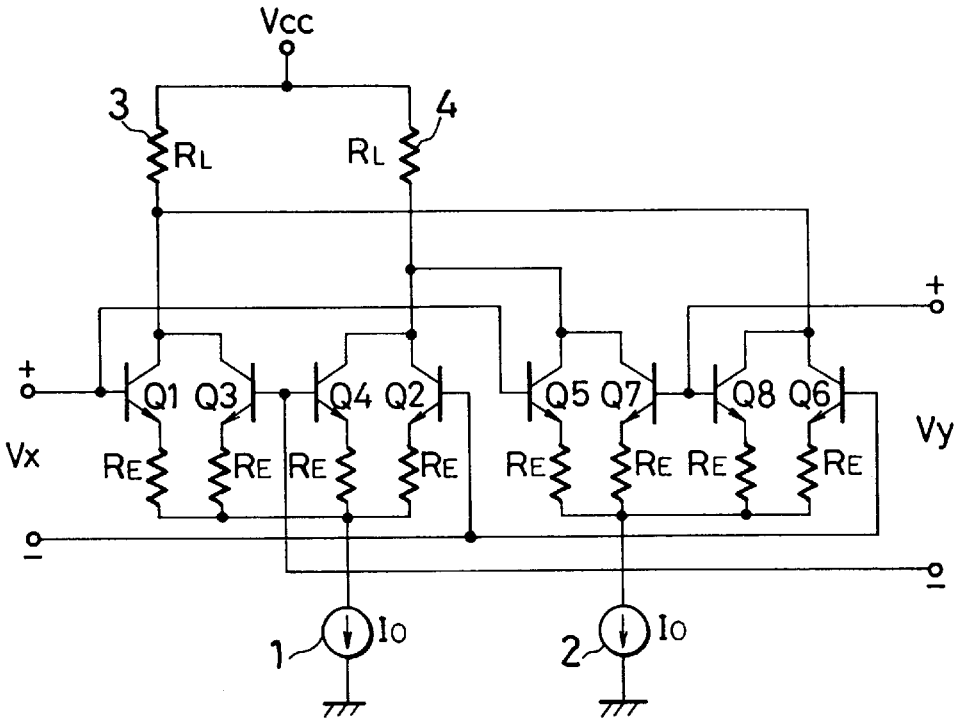
FIG. 23 is a circuit diagram of a multiplier according to a third embodiment of the present invention.

FIG. 23 shows a multiplier according to a third embodiment of the present invention, which is the same in configuration to the multiplier of the first embodiment other than that each of the bipolar transistors Q1, Q2, Q3, Q4, Q5, Q6, Q7 and Q8 has a resistor for degeneration at its emitter. The emitters of the transistors Q1, Q2, Q3 and Q4 are connected in common to the first constant current source 1 through the resistors whose resistance are equal to be $R_E$, respectively. The emitters of the transistors Q5, Q6, Q7 and Q8 are connected in common to the second constant current source 2 through the resistors whose resistance are equal to be $R_E$, respectively.

In the multiplier of the third embodiment, there is an additional advantage that the first and second input voltages $V_x$ and $V_y$ can be made wider in superiorly linear range than the first embodiment when the "degeneration value" is appropriately determined. Here, the "degeneration value" is defined as a product $R_E \cdot I_0$ of the resistance value $R_0$ of the respective resistors and the current value $I_0$ of the respective constant current sources 1 and 2.

[Fourth Embodiment]

Figure 24:
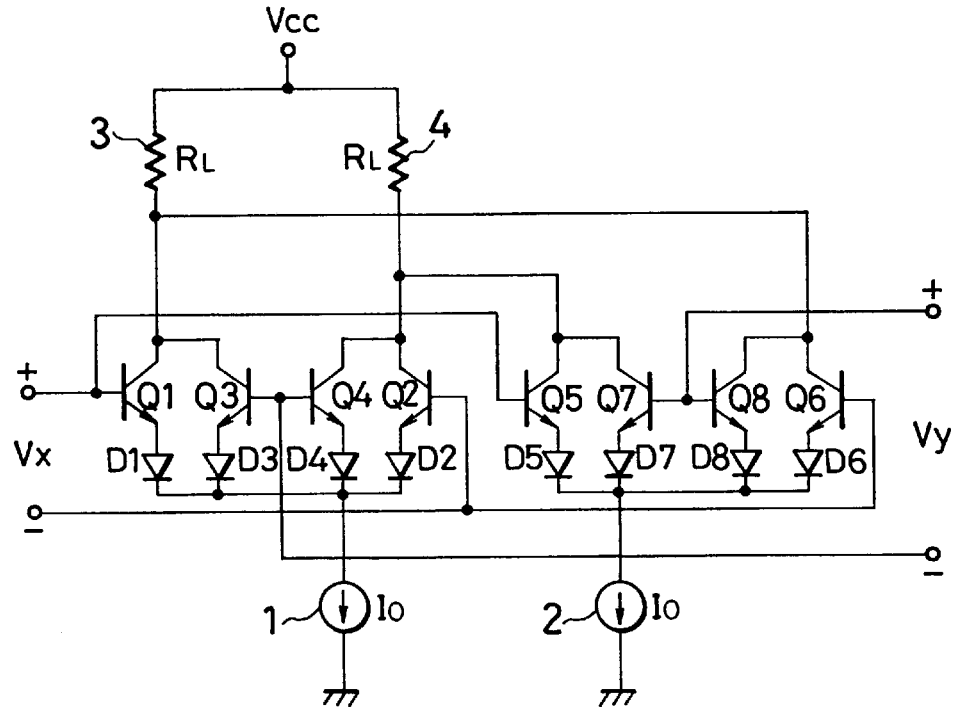
FIG. 24 is a circuit diagram of a multiplier according to a fourth embodiment of the present invention.

FIG. 24 shows a multiplier according to a fourth embodiment of the present invention, which is the same in configuration to the multiplier of the first embodiment other than that each of the bipolar transistors Q1, Q2, Q3, Q4, Q5, Q6, Q7 and Q8 has a diode for input-voltage division at its emitter. The emitters of the transistors Q1, Q2, Q3 and Q4 are connected in common to the first constant current source 1 through diodes $D_1$, $D_2$, $D_3$ and $D_4$, respectively. The emitters of the transistors Q5, Q6, Q7 and Q8 are connected in common to the second constant current source 2 through diodes $D_5$, $D_6$, $D_7$ and $D_8$, respectively.

In the multiplier of the fourth embodiment, similar to the third embodiment, the first and second input voltages $V_x$ and $V_y$ can be made two times in superiorly linear range as wide as those of the first embodiment while the operating power source voltage is required to be a little higher.

A bipolar transistor is employed as each diode in general, so that the operating power source voltage needs to be higher by the base-emitter voltage $V_{BE}$ of the bipolar transistor, or approximately 0.7 V. However, the operating power source voltage of the fourth embodiment can be made lower than that of the Gilbert multiplier cell since the operating ranges of the first and second input voltages $V_x$ and $V_y$ do not need to be determined separately like the Gilbert multiplier cell. Therefore, also in the fourth embodiment, the input voltage ranges can be enlarged with a low power source voltage.

Here, one diode is inserted to each transistor, however, n in number of diodes connected in series may be inserted thereto where n is a natural number. In this case, there arises an additional advantage that the operating input voltage ranges can be increased to be (n+1) times as wide as those (see FIGS. 14 and 15) of the first embodiment while the operating power source voltage needs to be higher by a voltage of ($n \times V_{BE}$).

As described above, in the multipliers of the first to fourth embodiments, at least one of the first and second input voltages $V_x$ and $V_y$ to be multiplied can be expanded in superiorly linear range compared with those of the prior-art multipliers even if operating at a low power source voltage such as 3 or 3.3 V.

What is claimed is:

1. A multiplier comprising:

a first quadritail circuit;

said first quadritail circuit containing a first pair of first and second transistors whose capacities are the same, a second pair of third and fourth transistors whose capacities are the same, and a first constant current source for driving said first and second pairs of transistors, wherein emitters of each said first, second, third, and fourth transistors are directly connected with no intervening elements to said first constant current source;

a second quadritail circuit;

said second quadritail circuit containing a third pair of fifth and sixth transistors whose capacities are the same, a fourth pair of seventh and eighth transistors whose capacities are the same, and a second constant current source for driving said third and fourth pairs of transistors, wherein emitters of each said fifth, sixth, seventh, and eighth transistors are directly connected with no intervening elements to said second constant current source;

a first input voltage operably applied between input ends of said first and said second transistors, input ends of said third and said fourth transistors being coupled together;

said first input voltage operably applied between input ends of said fifth and said sixth transistors, input ends of said seventh and said eighth transistors being coupled together;

a second input voltage operably applied to said coupled together input ends of said third and said fourth transistors;

said second input voltage operably applied to said coupled together input ends of said seventh and eighth transistors;

an output end of said first transistor connected with no intervening elements to an output end of said sixth transistor, and an output end of said second transistor being connected with no intervening elements to an output end of said fifth transistor to form a pair of differential output ends of said multiplier;

wherein a differential output voltage or output current of said multiplier is derived from said output ends of said multiplier.

2. The multiplier as claimed in claim 1, wherein load resistors are connected to said differential output ends of said multiplier, respectively.

3. A multiplier comprising:

a first quadritail circuit;

said first quadritail circuit containing a first pair of first and second bipolar transistors whose capacities are the same and whose collectors are coupled together, a second pair of third and fourth bipolar transistors whose capacities are the same and whose collectors are coupled together, and first constant current source for driving said first and second pairs of transistors;

emitters of said first, second, third and fourth transistors being connected in common to said first constant current source, where said emitters of said first, second, third and fourth transistors are in direct contact with one another with no intervening elements therebetween;

a second quadritail circuit;

said second quadritail circuit containing a third pair of fifth and sixth bipolar transistors whose capacities are the same and whose collectors are coupled together, a fourth pair of seventh and eighth bipolar transistors whose capacities are the same and whose collectors are coupled together, and a second constant current source for driving said third and fourth pairs of transistors;

emitters of said fifth, sixth, seventh and eighth transistors being connected in common to said second constant current source, wherein said emitters of said fifth, sixth, seventh, and eighth transistors are in direct contact with one another with no intervening elements therebetween;

a first input voltage operably applied between bases of said first and said fourth transistors;

bases of said second and said third transistors being coupled together;

said first input voltage operably applied between bases of said fifth and said eighth transistors;

bases of said sixth and said seventh transistors being coupled together;

a second input voltage operably applied to said coupled together bases of said second and said third transistors;

said second input voltage operably applied to said coupled together bases of said sixth and seventh transistors;

said collectors of said first and second transistors being connected with no intervening elements to said collectors of said seventh and eighth transistors, and said collectors of said third and fourth transistors being connected with no intervening elements to said collectors of said fifth and sixth transistors to form a pair of differential output ends of said multiplier;

wherein a differential output voltage or output current of said multiplier is derived from said output ends of said multiplier.

4. The multiplier as claimed in claim 3, wherein load resistors are connected to said differential output ends, respectively.

5. A multiplier comprising:

a first quadritail circuit;

said first quadritail circuit containing a first pair of first and second MOS transistors whose capacities are the same and whose drains are coupled together, a second pair of third and fourth MOS transistors whose capacities are the same and whose drains are coupled together, and a first constant current source for driving said first and second pairs of transistors;

sources of said first, second, third and fourth transistors being connected in common to said first constant current source, wherein said sources of said first, second, third and fourth transistors are in direct contact with one another with no intervening elements therebetween;

a second quadritail circuit;

said second quadritail circuit containing a third pair of fifth and sixth MOS transistors whose capacities are the same and whose drains are coupled together, a fourth pair of seventh and eighth MOS transistors whose capacities are the same and whose drains are coupled together, and a second constant current source for driving said third and fourth pairs of transistors;

sources of said fifth, sixth, seventh and eighth transistors being connected in common to said second constant current source, wherein said sources of said fifth, sixth, seventh and eighth transistors are in direct contact with one another with no intervening elements therebetween;

a first input voltage operably applied between gates of said first and said fourth transistors;

gates of said second and said third transistors being coupled together;

said first input voltage operably applied between gates of said fifth and said eighth transistors;

gates of said sixth and said seventh transistors being coupled together;

a second input voltage operably applied to said coupled together gates of said second and said third transistors;

said second input voltage operably applied to said coupled together gates of said sixth and said seventh transistors;

said drains of said first and second transistors being connected with no intervening elements to said drains of said seventh and eighth transistors, and said drains of said third and fourth transistors being connected with no intervening elements to said drains of said fifth and sixth transistors to form a pair of differential output ends of said multiplier;

wherein a differential output voltage or output current of said multiplier is derived from said output ends of said multiplier.

6. The multiplier as claimed in claim 5, wherein load resistors are connected to said differential output ends, respectively.

7. A multiplier comprising:

a first quadritail circuit;

said first quadritail circuit containing a first pair of first and second transistors whose capacities are the same, a second pair of third and fourth transistors whose capacities are the same, and a first constant current source for driving said first and second pairs of transistors, wherein said first, second, third, and fourth transistors have respective emitter portions extending therefrom;

a second quadritail circuit;

said second quadritail circuit containing a third pair of fifth and sixth transistors whose capacities are the same, a fourth pair of seventh and eighth transistors whose capacities are the same, and a second constant current source for driving said third and fourth pairs of transistors, wherein said fifth, sixth, seventh, and eighth transistors have respective emitter portions extending therefrom;

in said first quadritail circuit, a first input voltage being applied between input ends of said first and said second transistors, in said first quadritail circuit, input ends of said third and said fourth transistors being coupled together;

in said second quadritail circuit, said first input voltage being applied between input ends of said fifth and said sixth transistors, in said second quadritail circuit, input ends of said seventh and said eighth transistors being coupled together;

a second input voltage being applied between said input ends coupled together of said third and said fourth transistors and said input ends coupled together of said seventh and said eighth transistors;

an output end of said first transistor connected to an output end of an sixth transistor, and an output end of said second transistor connected to an output end of said fifth transistor to form a pair of differential output ends of said multiplier;

wherein a differential output voltage or output current of said multiplier is derived from said output ends of an multiplier wherein each of said first, second, third and fourth transistors has a diode connected to said corresponding emitter, and said emitters of said first, second, third and fourth transistors are connected in common to said first constant current source through said respective diodes, and wherein each of said fifth, sixth, seventh and eighth transistors has a diode connected to said corresponding emitter, and said emitters of said fifth, sixth, seventh and eighth transistors are connected in common to said second constant current source through said respective diodes.

8. A multiplier comprising:

a first quadritail circuit;

said first quadritail circuit containing a first pair of first and second bipolar transistors whose capacities are the same and whose collectors are coupled together, a second pair of third and fourth bipolar transistors whose capacities are the same and whose collectors are coupled together, and a first constant current source for driving said first and second pairs of transistors;

emitters of said first, second, third and fourth transistors being connected in common to said first constant current source;

a second quadritail circuit;

said second quadritail circuit containing a third pair of fifth and sixth bipolar transistors whose capacities are the same and whose collectors are coupled together, a fourth pair of seventh and eighth bipolar transistors whose capacities are the same and whose collectors are coupled together, and a second constant current source for driving said third and fourth pairs of transistors;

emitters of said fifth, sixth, seventh and eighth transistors being connected in common to said second constant current source;

a first input voltage being applied between bases of said first and said fourth transistors;

bases of said second and said third transistors being coupled together;

said first input voltage being applied between bases of said fifth and said eighth transistors;

bases of said sixth and said seventh transistors being coupled together;

a second input voltage being applied between said bases coupled together of said second and said third transistors, and said bases coupled together of said sixth and said seventh transistors;

said collectors of said first and second transistors being connected to said collectors of said seventh and eighth transistors, and said collectors of said third and fourth transistors being connected to said collectors of said fifth and sixth transistors to form a pair of differential output ends of said multiplier;

wherein a differential output voltage or output current of said multiplier is derived from said output ends of said multiplier, wherein each of said first, second, third and fourth transistors has a diode connected to said corresponding emitter, and said emitters of said first, second, third and fourth transistors are connected in common to said first constant current source through said respective diodes, and wherein each of said fifth, sixth, seventh and eighth transistors has a diode connected to said corresponding emitter, and said emitters of said fifth, sixth, seventh and eighth transistors are connected in common to said second constant current source through said respective diodes.

9. A multiplier comprising:

a first quadritail circuit;

said first quadritail circuit containing a first pair of first and second transistors whose capacities are the same, a second pair of third and fourth transistors whose capacities are the same, and a first constant current source for driving said first and second pairs of transistors, each of said first, second, third and fourth transistors having a resistor connected to a corresponding emitter thereof, with said emitters of said first, second, third and fourth transistors being connected in common to said first constant current source through said respective resistors thereof;

a second quadritail circuit;

said second quadritail circuit containing a third pair of fifth and sixth transistors whose capacities are the same, a fourth pair of seventh and eighth transistors whose capacities are the same, and a second constant current source for driving said third and fourth pairs of transistors, each of said fifth, sixth, seventh and eighth transistors having a resistor connected to a corresponding emitter thereof, with said emitters of said fifth, sixth, seventh and eighth transistors being connected in common to said second constant current source through said respective resistors thereof;

in said first quadritail circuit, a first input voltage being applied between input ends of said first and said second transistors, in said first quadritail circuit, input ends of said third and said fourth transistors being coupled together;

in said second quadritail circuit, said first input voltage being applied between input ends of said fifth and said sixth transistors, in said second quadritail circuit, input ends of said seventh and said eighth transistors being coupled together;

a second input voltage being applied between said input ends coupled together of said third and said fourth transistors and said input ends coupled together of said seventh and said eighth transistors;

an output end of said first transistor connected to an output end of said sixth transistor, and an output end of an second transistor connected to an output end of said fifth transistor to form a pair of differential output ends of said multiplier;

wherein a differential output voltage or output current of said multiplier is derived from said output ends of said multiplier.

10. A multiplier comprising:

a first quadritail circuit;

said first quadritail circuit containing a first pair of first and second bipolar transistors whose capacities are the same and whose collectors are coupled together, a second pair of third and fourth bipolar transistors whose capacities are the same and whose collectors are coupled together, and a first constant current source for driving said first and second pairs of transistors, each of said first, second, third and fourth transistors having a resistor connected to a corresponding emitter thereof, with said emitters of said first, second, third and fourth transistors being connected in common to said first constant current source through said respective resistors thereof;

a second quadritail circuit;

said second quadritail circuit containing a third pair of fifth and sixth bipolar transistors whose capacities are the same and whose collectors are coupled together, a fourth pair of seventh and eighth bipolar transistors whose capacities are the same and whose collectors are coupled together, and a second constant current source for driving said third and fourth pairs of transistors, each of said fifth, sixth, seventh and eighth transistors having a resistor connected to a corresponding emitter thereof, with said emitters of said fifth, sixth, seventh and eighths transistors being connected in common to said second constant current source through said respective resistors thereof;

a first input voltage being applied between bases of said first and said fourth transistors;

bases of said second and said third transistors being coupled together;

said first input voltage being applied between bases of said fifth and said eighth transistors;

bases of said sixth and said seventh transistors being coupled together;

a second input voltage being applied between said bases coupled together of said second and said third transistors, and said bases coupled together of said sixth and said seventh transistors;

said collectors of said first and second transistors being connected to said collectors of said seventh and eighth transistors, and said collectors of said third and fourth transistors being connected to said collectors of said fifth and sixth transistors to form a pair of differential output ends of said multiplier;

wherein a differential output voltage or output current of said multiplier is derived from said output ends of said multiplier.

* * * * *

UNITED STATES PATENT AND TRADEMARK OFFICE

CERTIFICATE OF CORRECTION

PATENT NO. : 5,889,425
DATED : March 30, 1999
INVENTOR(S) : Katsuji KIMURA

It is certified that error appears in the above-indentified patent and that said Letters Patent is hereby corrected as shown below:

Column 13, (equation 16), line 1, delete "$\leq |V_y|$" and insert --$\leq |V_x|$--.

Column 14, equation 21, line 53, delete "$\sqrt{\frac{2I_0}{\beta} - \frac{2}{9}}$" and insert --$\sqrt{\frac{2I_0}{3\beta} - \frac{2}{9}}$--.

Column 15, equation 22, delete "$\sqrt{\frac{2I_0}{\beta} - \frac{2}{9}}$" and insert --$\sqrt{\frac{2I_0}{3\beta} - \frac{2}{9}}$--.

Signed and Sealed this

Twelfth Day of October, 1999

*Attest:*

Q. TODD DICKINSON

*Attesting Officer*

*Acting Commissioner of Patents and Trademarks*